US006609604B1

(12) United States Patent
Jones et al.

(10) Patent No.: US 6,609,604 B1
(45) Date of Patent: Aug. 26, 2003

(54) COIN PROCESSING SYSTEM FOR DISCRIMINATING AND COUNTING COINS FROM MULTIPLE COUNTRIES

(75) Inventors: William J. Jones, Barrington, IL (US); Douglas U. Mennie, Barrington, IL (US); Joseph J. Geib, Hot Springs Village, AR (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 09/646,446

(22) PCT Filed: Mar. 17, 1999

(86) PCT No.: PCT/US99/05800

§ 371 (c)(1),
(2), (4) Date: Nov. 13, 2000

(87) PCT Pub. No.: WO99/48058

PCT Pub. Date: Sep. 23, 1999

Related U.S. Application Data

(60) Provisional application No. 60/078,976, filed on Mar. 18, 1998.

(51) Int. Cl.[7] ..... G07D 3/00; G07D 5/00

(52) U.S. Cl. ..... 194/302; 194/317

(58) Field of Search ..... 194/302, 215, 194/216, 217, 294, 334, 317, 318, 319; 453/3, 29, 32, 4

(56) References Cited

U.S. PATENT DOCUMENTS

| | | | |
|---|---|---|---|
| 1,378,720 A | 5/1921 | Roeling et al. | |
| 1,421,992 A | 7/1922 | Roeling et al. | |
| 3,748,821 A | 7/1973 | Hull et al. | 53/159 |

(List continued on next page.)

FOREIGN PATENT DOCUMENTS

| | | | |
|---|---|---|---|
| EP | 798 669 A2 | 10/1997 | G07D/5/10 |
| GB | 2 117 953 A | 10/1983 | G07D/3/06 |

OTHER PUBLICATIONS

Brochure, Model 920/925, Brandt Inc., 2 pages (no date—date believed to be prior to filing date of pending U.S. application).

Brochure, System 930 Electric Counter/Sorter and Model 755 Security Stand, Brandt Inc., 1 page (no date—date believed to be prior to filing date of pending U.S. application).

Brochure, Model 940–6 High Speed Sorter/Counter, Brandt Inc., 2 pages (no date—date believed to be prior to filing date of pending U.S. application).

Brochure, System 945, Brandt Inc., 2 pages (no date—date believed to be prior to filing date of pending U.S. application).

(List continued on next page.)

*Primary Examiner*—Donald P. Walsh
*Assistant Examiner*—Mark J. Beauchaine
(74) *Attorney, Agent, or Firm*—Jenkens & Gilchrist

(57) ABSTRACT

A system for processing mixed coins including coins from a first coin set and coins from a second coin set is set forth. The coin processing system includes a coin set discrimination device including a coin input region in which the mixed coins are placed. The discrimination device includes means for discriminating between coins of the first coin set and coins of the second coin set and means for transporting coins to a first exit region and a second exit region. Coins from the first coin set are transported to the first exit region. Coins from the second coin set are transported to the second exit region. The processing system also includes first and second coin sorters that receive coins from the first exit region and the second exit region, respectively. The first and second coin sorters sort and count coins of the first and second coin sets, respectively.

37 Claims, 22 Drawing Sheets

U.S. PATENT DOCUMENTS

| | | | | | |
|---|---|---|---|---|---|
| 3,757,805 | A | | 9/1973 | Puhahn et al. | 133/8 R |
| 4,059,122 | A | | 11/1977 | Kinoshita | 133/3 D |
| 4,383,540 | A | | 5/1983 | De Meyer et al. | 133/3 H |
| 4,682,288 | A | | 7/1987 | Taipale et al. | 364/406 |
| 4,883,158 | A | | 11/1989 | Kobayashi et al. | 194/217 |
| 4,898,564 | A | | 2/1990 | Gunn et al. | 453/3 |
| 4,953,086 | A | | 8/1990 | Fukatsu | 364/408 |
| 5,052,538 | A | | 10/1991 | Satoh | 194/317 |
| 5,163,868 | A | | 11/1992 | Adams et al. | 453/11 |
| 5,195,626 | A | | 3/1993 | Le Hong et al. | 194/317 |
| 5,295,899 | A | | 3/1994 | Adams et al. | 453/10 |
| 5,346,049 | A | | 9/1994 | Nakajima et al. | 194/328 |
| 5,468,182 | A | * | 11/1995 | Geib | 194/338 |
| 5,494,147 | A | | 2/1996 | Takahashi et al. | 194/328 |
| 5,525,104 | A | | 6/1996 | Adams et al. | 453/10 |
| 5,542,880 | A | | 8/1996 | Geib et al. | 453/10 |
| 5,576,825 | A | | 11/1996 | Nakajima et al. | 356/71 |
| 5,620,079 | A | | 4/1997 | Molbak | 194/217 |
| 5,624,308 | A | | 4/1997 | Rumbach | 453/3 |
| 5,630,494 | A | | 5/1997 | Strauts | 194/317 |
| 5,782,686 | A | * | 7/1998 | Geib et al. | 453/10 |
| 5,799,767 | A | | 9/1998 | Molbak | 194/217 |
| 5,865,673 | A | | 2/1999 | Geib et al. | 453/10 |
| 5,905,810 | A | | 5/1999 | Jones et al. | 382/135 |
| 5,982,918 | A | | 11/1999 | Mennie et al. | 382/135 |
| 5,992,602 | A | * | 11/1999 | Zwieg et al. | 194/317 |
| 5,997,395 | A | | 12/1999 | Geib et al. | 453/10 |
| 6,021,883 | A | | 2/2000 | Casanova et al. | 194/217 |
| 6,080,056 | A | * | 6/2000 | Karlsson | 453/3 |

OTHER PUBLICATIONS

Brochure, 95 Series Coin Sorter/Counter, Brandt Inc., 2 pages (no date—date believed to be prior to filing date of pending U.S. application).

Brochure, Model 952 Coin Sorter/Counter, Brandt Inc., 2 pages (no date—date believed to be prior to filing date of pending U.S. application).

Brochure, Model 954 Coin Sorter/Counter, Brandt Inc., 2 pages (no date—date believed to be prior to filind date of pending U.S. application).

Brochure, Model 957 Coin Sorter/Counter, Brandt Inc., 2 pages (no date—date believed to be prior to filing date of pending U.S. application).

Brochure, Model 958 Coin Sorter/Counter, Brandt Inc., 5 pages (no date—date believed to be prior to filing date of pending U.S. application).

Brochure, Model 960 High–Speed Coin Sorter & Counter, Brandt Inc., 2 pages (no date—date believed to be prior to filing date of pending U.S. application).

Brochure, Model 966 Microsort™ Coin Sorter and Counter, Brandt Inc., 4 pages (1979).

Brochure, Model 970 Coin Sorter & Counter, Brandt Inc., 2 pages (1983).

Brochure, CA–750 JetSort Coin Processor, Cummins–Allison Corp., 1 page (no date—date believed to be prior to filing date of pending U.S. application).

Brochure, High Speed Coin Sorter/Counter 2000 Series, Cummin–Allison Corp., 2 pages (no date—date believed to be prior to filing date of pending U.S. application).

Brochure, High Speed Coin Sorters 3000 Series, Cummins–Allison Corp., 2 pages (no date—date believed to be prior to filing date of pending U.S. application).

Brochure, JetSort 3000 Series, Cummins–Allison Corp., 2 pages (no date—date believed to be prior to filing date of pending U.S. application).

Brochure, Cash Information & Settlement Systems, Cummins–Allison Corp., 4 pages (no date—date believed to be prior to filing date of pending U.S. application).

Brochure, CPS 300 Currency Processing System, Currency Systems International, Inc., 4 pages (1992).

Brochure, CPS 600 and CPS 900 Medium Speed Currency Sorting Family, Currency Systems International, Inc., 4 pages (1994).

Brochure, CPS 1200, Currency Systems International, Inc., 4 pages (1992).

Brochure, Childers Magnum Computerized Sorter/Counter, Childers Corporation, 2 pages (no date—date believed to be prior to filing date of pending U.S. application).

Brochure, CDS602 Cash Deposit System, CTcoin, 1 page (no date—date believed to be prior to filing date of pending U.S. application).

Brochure, AI–I500 Pulsar, Amiel Industries, 13 pages (no date—date believed to be prior to filing date of pending U.S. application).

Brochure, Express Banking Center, Hamilton, 4 pages (no date—date believed to be prior to filing date of pending U.S. application).

Brochure, AMT Automated Merchant Teller, Glory (U.S.A.) Inc., 4 pages (no date—date believed to be prior to filing date of pending U.S. application).

Brochure, Money Processing Systems, Scan Coin AB, 12 pages (no date—date believed to be prior to filing date of pending U.S. application).

* cited by examiner

COIN PROCESSING SYSTEM FOR DISCRIMINATING AND COUNTING COINS FROM MULTIPLE COUNTRIES

RELATED APPLICATIONS

This application is a U.S. national phase of International Application No. PCT/US99/05800, filed Mar. 17, 1999, which is a completer and foreign application of U.S. Application No. 60/078,976, filed Mar. 18, 1998, now abandoned.

FIELD OF THE INVENTION

The present invention relates generally to a coin processing system and, more particularly, to a system where coins from two different currencies are placed into a coin loader which sorts the coins into the two currencies and transfers the sorted coins into two separate coin sorting machines which counts the coins and provides the total value for each currency.

BACKGROUND OF THE INVENTION

In many regions of the world, coins from two different currencies are in circulation. For example, in many cities which are located on the border between two countries, consumers typically have in their possession coins from each country. Often, retailers will accept either currency from consumers in exchange for goods or services. Consequently, the coins from the different countries are often mixed together by retailers which forces the retailer to sort the coins into the two currencies before determining their value.

Coin sorters have been used for a number of years. However, these coin sorters often sort coins based on the diameters of the coins. Because two coins for two currencies may have substantially the same diameter, a typical coin sorter which sorts coins based on the diameters of the coins would not be able to accurately sort the coins since the coins having the same diameters would be sorted into the same coin receptacle. Moreover, most sorters which sort coins based on the diameters of the coins do not have the capability of sorting a large number of denominations. For example, the coin set of one country may have six coins while the coin set of the other country may have eight coins which would require the sorting of fourteen different coins.

Thus, a need exists for a coin processing system which first sorts the mixed batch of coins into the two currencies (i.e. the coin set for Country A and the coin set for Country B) and then further sorts and counts the coins from each of the two currencies.

SUMMARY OF THE INVENTION

It is a primary object of this invention to provide a coin processing system that sorts a mixed batch of coins from two currencies and then determines the value of the entire batch.

The coin processing system includes a coin loader which receives coins from the operator. The coin loader determines whether each coin is from the coin set for Country A or Country B and separates the coins into a first path of coins for Country A and a second path of coins for Country B. Each stream of coins then enters a coin sorter which sorts the coins into the particular denominations for the coin set and provides a value of the entire batch.

To accomplish these tasks, the coin loader includes various sensors to determine whether each coin is from Country A or Country B. In response to the sensing of each coin, the coin loader actuates a diverter mechanism which results in two possible coin paths, one for the coins of the first currency (Country A) and the other for the coins of the second currency (Country B). Each of these coin paths leads to a corresponding coin sorter.

The coin sorters can utilize various technologies which sort the coins by denomination and determine the value of each batch. For example, the coin sorters may include sorting technology which includes a stationary sorting head and a rotatable disc. Or, each of the coin sorters can be what is commonly known as a rail sorter. Furthermore, the coin sorters may be of the type which has dual rotating discs that overlap near their peripheries.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENTS

Figure 1:
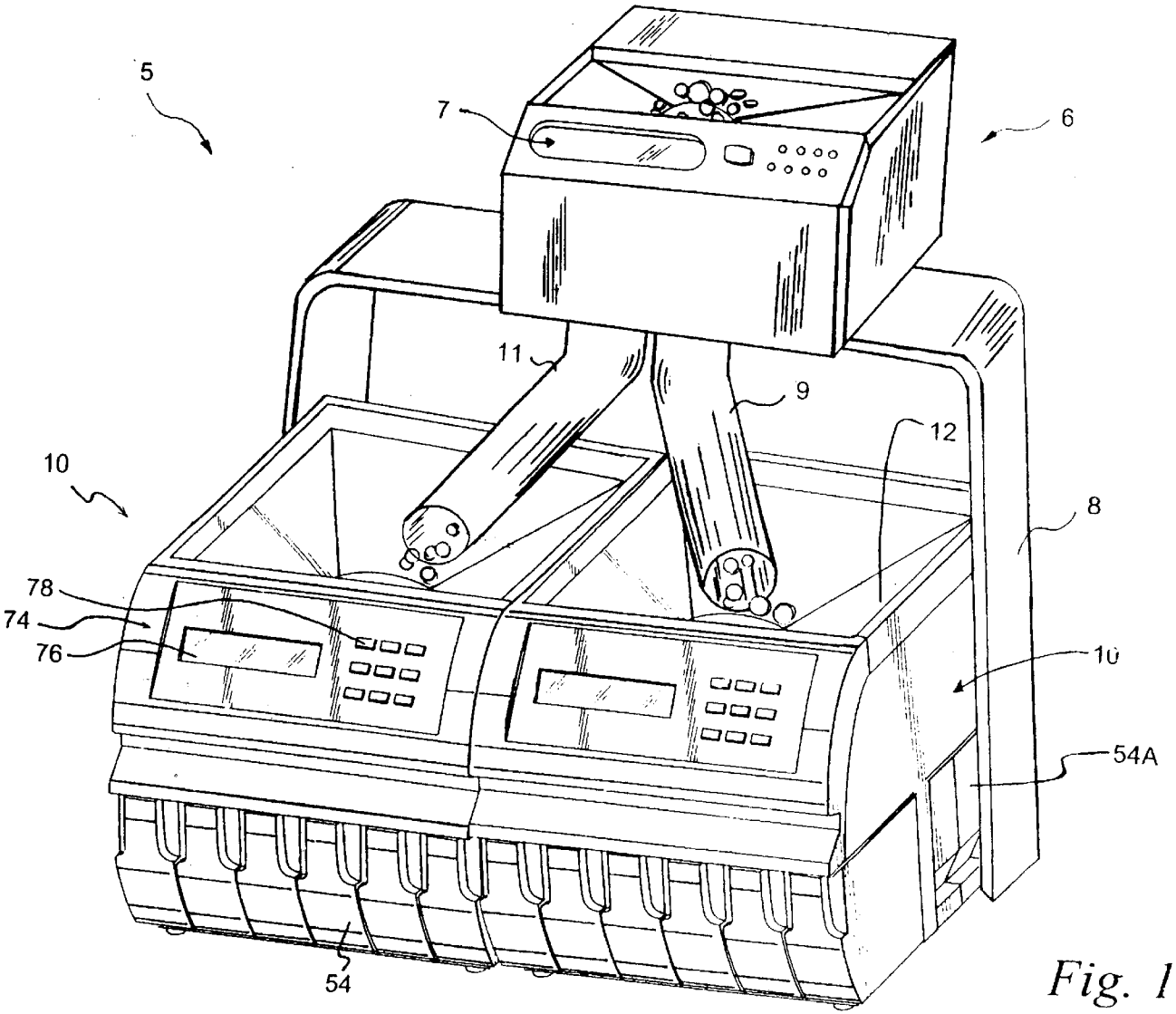
FIG. 1 is perspective view of a coin processing system embodying the present invention.
Figure 2:
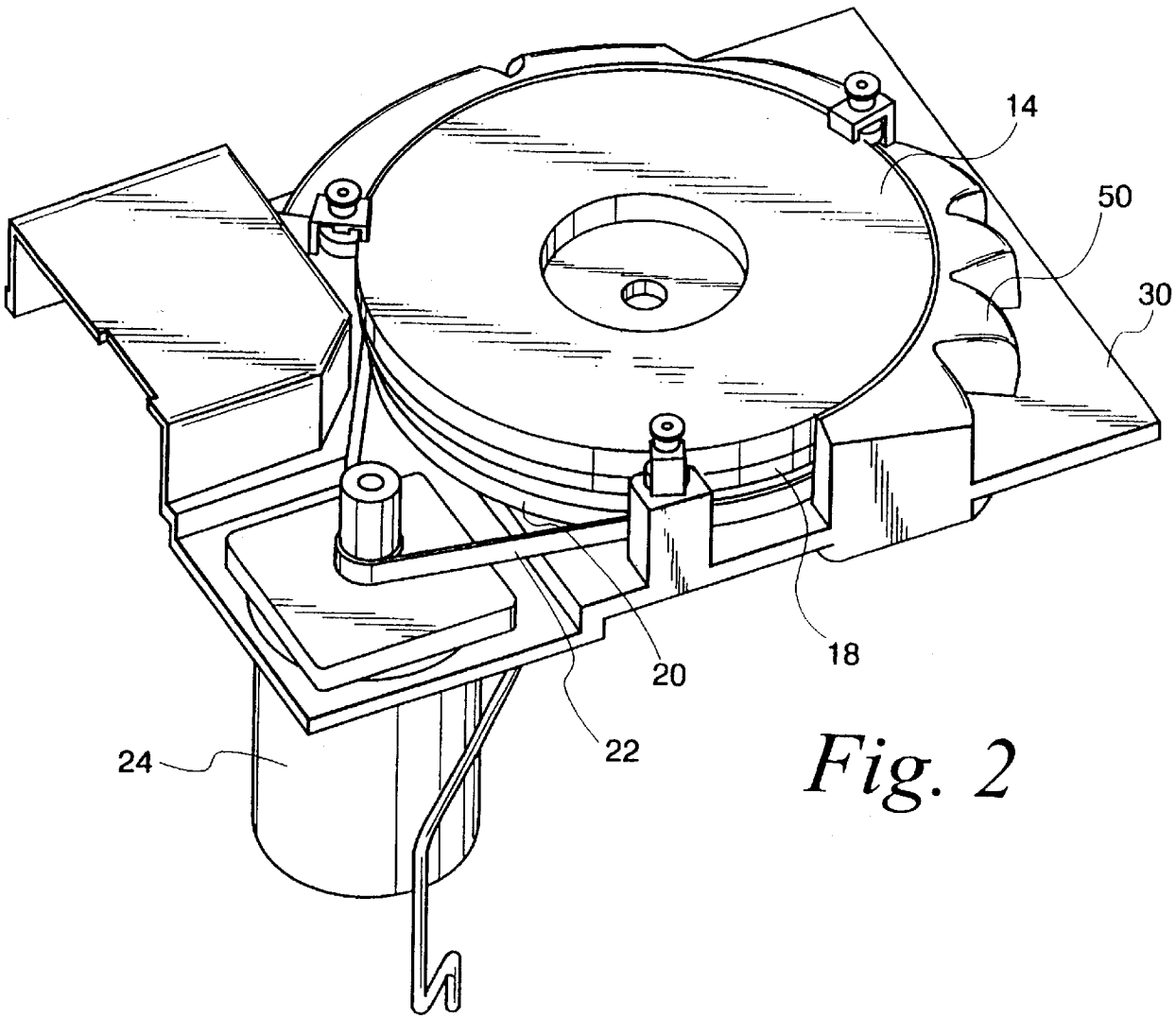
FIG. 2 is a perspective view of the sorting head and rotatable disc of each coin sorter.

Turning now to the drawings and referring first to FIG. 1, a coin processing system 5 includes a coin loader 6 which rests on a mounting structure 8 above two coin sorters 10. The coin loader 6 discriminates between coins of two different currencies and sends coins of a first currency to one coin sorter 10 via a first chute 9 and coins of a second currency to a second coin sorter 10 via a second coin chute 11.

As illustrated, the coin loader 6 is positioned above the two coin sorters 10. Thus, the coin flow through the coin chutes 9 and 11 is at least partially due to gravity. While the bottom end of the coin chutes 9 and 11 are shown as being opened, these ends could be attached to the coin sorters 10 such that the operator would not see the coins entering the coin sorters 10. However, in the configuration shown in FIG. 1, the operator has the option of placing coins directly into either coin sorter 10 without adjusting the chutes 9 and 11.

The coin sorters 10 can be mechanically connected by fasteners or merely sitting adjacent to one another as shown in FIG. 1. In fact, the fastening mechanism can simply be coupled to the sides of the mounting structure 8 on which the coin loader 6 is placed. The mounting structure 8 would have three fastening mechanism, two for the coin sorters 10 and one for the coin loader 6. Thus, the coin processing system 5 would be packaged as an integrated unit.

The coin loader 6 includes an operator interface panel 7 that is positioned on the front of the coin loader 6. The operator of the coin processing system 5 uses the keys present on the operator interface panel 7 to be begin the operation of the coin processing system 5. Each of the coin sorters 10 includes an operator interface panel 74 with keys 76 which the operator also utilizes to begin the sorting process for each of the countries' coin set. To provide more flexibility in the operation of the coin loader 6 and to simplify its operation, the operator interface panel 7 may include a touch screen which displays information to the operator and also receives the operator's input via depressible touch screen display keys.

It should also be noted that each coin sorter 10 is usually configured with a communication port which would allow it to be coupled to the coin loader 6 such that the operator only needs to manipulate the control panel 7 of the coin loader 6 to effectuate the operation of the coin sorters 10. In other words, the operator would control the entire functioning of the coin processing system 5 through the control panel 7 on the coin loader 6. Conversely, because the coin loader 6 and the coin sorters 10 can be electronically coupled through communication ports, the coin processing system 5 can be controlled entirely by having the operator manipulate the control panel 74 on one of the coin sorters 10. In this configuration, the need for the control panel 7 on the coin loader 6 is eliminated and the coin loader 6 can be considered a peripheral device to the coin sorters 10. It should be noted that the coin sorters 10 are often stand-alone units and, thus, will typically include their own control panels.

The two coin sorters 10 will first be described and then coin loader 6 will be described. With reference to FIGS. 1–4, each coin sorter 10 includes a coin tray 12 which receives coins from one county in mixed denominations and feeds them through a central coin hopper into an opening in an annular sorting head 14 positioned below the coin tray 12. As the coins pass through the central opening of the sorting head 14, they are deposited on the top surface of a rotatable disc 16. The rotatable disc 16 comprises a resilient pad 18, preferably made of a resilient rubber or polymeric material, bonded to the top surface of a solid disc 20.

As the rotatable disc 16 rotates, the coins deposited on the top surface thereof tend to slide outwardly across the surface of the pad 18 of the rotatable disc 16 due to the centrifugal force. As the coins move outwardly, those coins which are lying flat on the pad 18 enter the gap between the upper surface of the pad 18 and the sorting head 14 because the underside of the inner periphery of the sorting head 14 is spaced above the pad 18 by a distance which is approximately as large as the thickness of the thickest coin. As further described below, the coins are sorted into their respective denominations and discharged from exit channels corresponding to their denominations.

The rotatable disc 16 is driven by a belt 22 which is connected to a motor 24. The motor 24 can be an AC or a DC motor. In a preferred embodiment, the motor 24 is a DC motor with the capability of delivering variable revolutions per minute (rpms). The direction of the current through the motor 24 can be changed such that the motor 24 can act upon the rotatable disc 16 to decelerate the disc 16 in addition to accelerating it. In an alternative embodiment, a braking mechanism connected to the motor or to the rotatable disc 16 can assist in decelerating the rotatable disc 16.

The rotatable disc 16 and sorting head 14 are mounted concentrically on a unitary base member 30 which includes a plurality of integral coin chutes 50. Coins for a particular denomination are discharged from the sorting head 14 into a corresponding coin chute 50 which leads to one of the coin bins 54 as will described in more detail in FIG. 4.

The operator control panel 74 is used by the operator to control the coin sorter system 10. The control panel 74 includes a display 76 for displaying information about the coin sorter 10. The control panel 74 also includes keys 78 allowing the operator to enter information to the coin sorter 10. The control panel 74 also serves a structural purpose in that it is the surface which closes the upper front portion of the coin sorter 10. The control panel 74 may also include a touch screen device which provides more versatility to the operator when inputting information to the coin sorter 10.

Figure 3A:
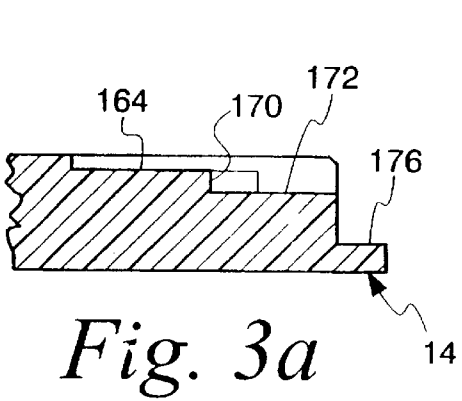
FIG. 3A is a cross-sectional view through one of the exit channels in the sorting head of FIG. 3 taken along line 3A—3A.
Figure 3B:
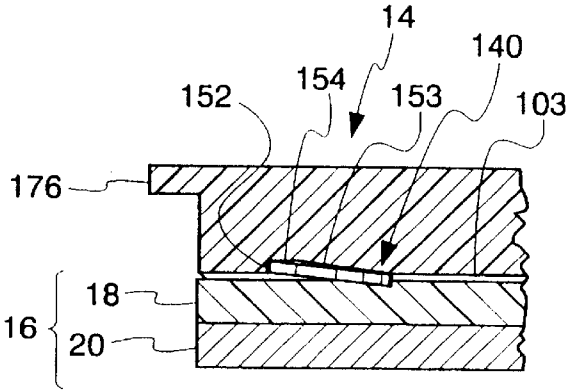
FIG. 3B is a cross-sectional view through the gauging region of the sorting head of FIG. 3 taken along line 3B—3B.
Figure 3:
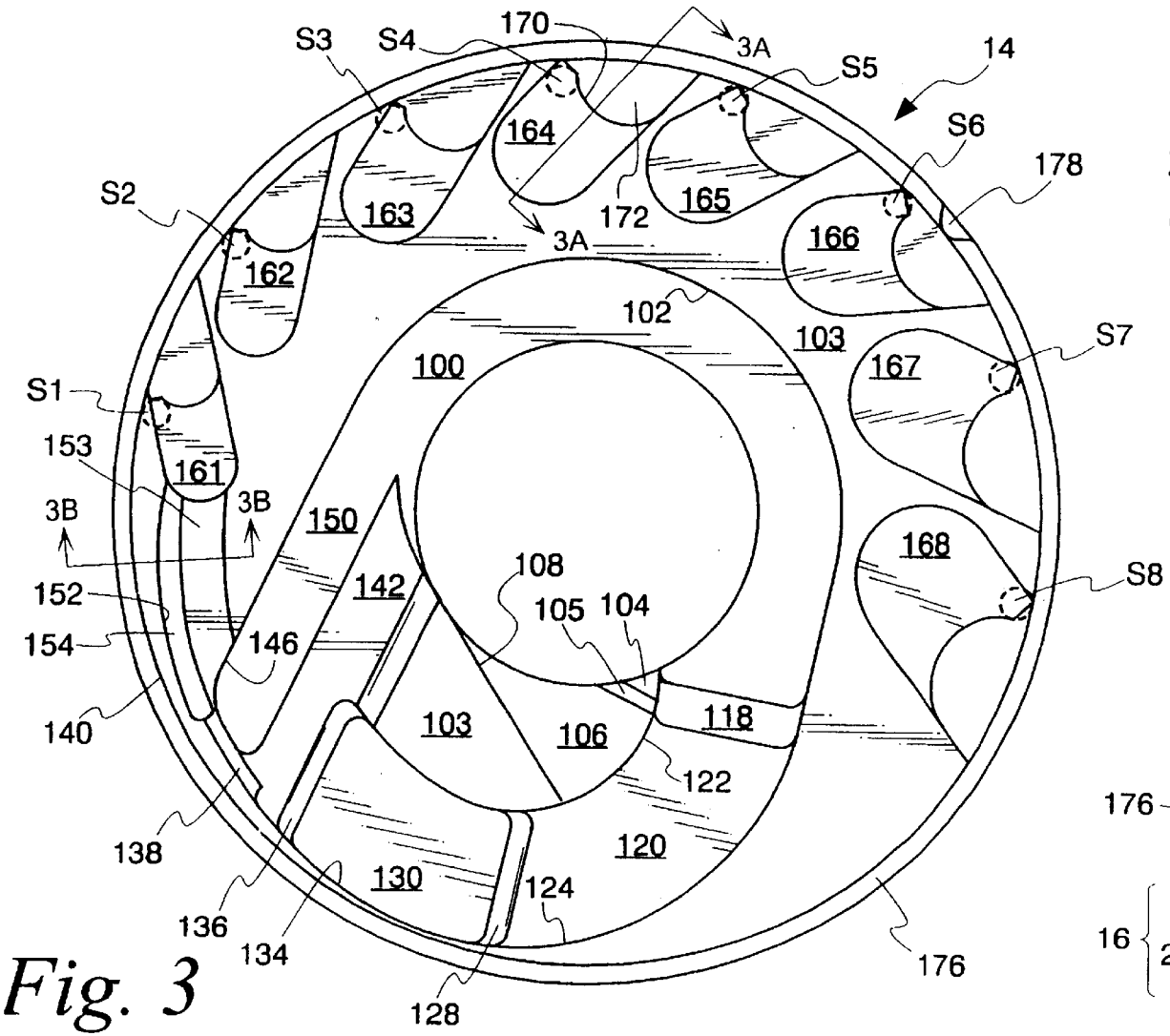
FIG. 3 is a bottom view of the sorting head that is used in the coin sorter of the present invention.

Referring now to FIGS. 3, 3A and 3B, the coin set for one particular country is sorted into denominations by the sorting head 14 due to variations in their diameters. The coins circulate between the sorting head 14 and the pad 18 on the rotatable disc 16. The coins initially enter an entry channel 100 formed in the underside of the sorting head 14 after being deposited in the coin tray 12. It should be kept in mind that the circulation of the coins is clockwise in FIG. 3, but appears counter-clockwise when viewing the coin sorter 10 since FIG. 3 is a bottom view.

An outer wall 102 of the entry channel 100 divides the entry channel 100 from the lowermost surface 103 of the sorting head 14. The lowermost surface 103 is preferably spaced from the top surface of the pad 18 by a distance which is slightly less than the thickness of the thinnest coins. Consequently, the initial outward movement of all of the coins is terminated when they engage the outer wall 102 of the entry channel 100, although the coins continue to move circumferentially along the wall 102 by the rotational movement imparted on them by the pad 18 of the rotatable disc 16.

In some cases, coins may be stacked on top of each other. Because these stacked coins will be under pad pressure, they may not move radially outward toward wall 102. These stacked coins which are not against wall 102 must be recirculated. To recirculate the coins, the stacked coins encounter a separating wall 104 whereby the upper coin of the stacked coins engages the separating wall 104. The stacked coins are typically to the right (when viewing FIG. 3) of the lead edge of separating wall 104 when the upper coin engages the separating wall 104. While the separating wall 104 prohibits the further circumferential movement of the upper coin, the lower coin continues moving circumferentially across separating wall 104, along ramp 105, and into the region defined by surface 106 where the lower coin is in pressed engagement with the pad 18. Once in a pressed engagement with the pad 18 by surface 106, the recirculated lower coin remains in the same radial position, but moves circumferentially along the surface 106 until engaging recirculating wall 108 where it is directed toward the entry channel 100. The recirculating wall 108 separates surface 106 from a portion of the lower most surface 103. The upper coin of the stacked coins, on the other hand, moves up ramp 118 and into a queuing channel 120.

Those coins which were initially aligned along wall 102 (and the upper coins of stacked coins which engage separating wall 104) move across the ramp 118 leading to the queuing channel 120. The queuing channel 120 is formed by an inside wall 122 and an outside wall 124. The coins that reach the queuing channel 120 continue moving circumferentially and radially outward along the queuing channel 120 due to the rotation of the rotatable disc 16. The radial movement is due to the fact that queuing channel 120 has a height which is greater than the thickest coins so coins are not in engagement with queuing channel 120 and move outwardly on the pad due the centrifugal force of rotation. The outside wall 124 of the queuing channel 120 prohibits the radial movement of the coins beyond the queuing channel 120. The queuing channel 120 cannot be too deep since this would increase the risk of accumulating stacked or "shingled" coins (i.e. coins having only portions which are overlapped) in the queuing channel 120.

In the queuing channel 120, if stacked or "shingled" coins exist, they are under pad pressure and tend to remain in the same radial position. Consequently, as the stacked or "shingled" coins move circumferentially and maintain their radial position, the inside wall 122 engages the upper coin of the "shingled" or stacked coins, tending to separate the coins. The lower coin often engages the surface 106 where it remains under pad pressure causing it to retain its radial position while moving circumferentially with the pad 18. Thus, while the upper coin remains within queuing channel 120, the lower coin passes under the surface 106 for recirculation.

As these coins enter the queuing channel 120, the coins are further permitted to move outwardly and desirably engage the outside wall 124 of the queuing channel 120. The outside wall 124 of the queuing channel 120 blends into the outside wall 102 of the entrance region 100. After the coins enter the queuing channel 120, the coins are desirably in a single-file stream of coins directed against the outside wall 124 of the queuing channel 120.

As the coins move circumferentially along the outside wall 124, the coins engage another ramp 128 which leads to a deep channel 130 where the coins are aligned against the outer wall 134. The outer wall 134 decreases in radius with respect to the central axis of the sorting head 14 when moving in clockwise direction. By decreasing the radius of exterior wall 134, the coins are encouraged to be aligned along the outer wall 134 such that they are in a single file line moving through the deep channel 130 along outer wall 134.

The coins which are aligned along outer wall 134 then move past ramp 136 onto narrow bridge 138. The narrow bridge 138 leads down to the lowermost surface 103 of the sorting head 14. At the downstream end of the narrow bridge 138, the coins are firmly pressed into the pad 18 and are under the positive control of the rotatable disc 16. Therefore, the radial position of the coins is maintained as the coins move circumferentially into a gauging region 140.

If any coin in the stream of coins leading up to the narrow bridge 138 is not sufficiently close to the wall 134 so as to engage the narrow bridge 138, then the misaligned coin moves into surface 142 and engages an outer wall 146 of a reject pocket 150. When the leading edge of the misaligned coin hits wall 146, the misaligned coins are guided back to the entry channel 100 for recirculation via the reject pocket 150.

To summarize, the coins which do not engage narrow ramp 138 can be generally placed into two groups. First, those coins which did not entirely proceed through the queuing channel 120, but instead proceeded past surface 106 back toward the center of the sorting head 14. And, the second group of coins are those coins that missed the narrow ramp 138 and subsequently moved into reject pocket 150.

The first exit channel 161 is dedicated to the smallest coin to be sorted. Beyond the first exit channel 161, the sorting head 14 forms up to seven more exit channels 162–168 which discharge coins of different denominations at different circumferential locations around the periphery of the sorting head 14. Thus, the exit channels 161–168 are spaced circumferentially around the outer periphery of the sorting head 14 with the innermost edges of successive channels located progressively closer to the center of the sorting head 14 so that coins are discharged in the order of increasing diameter.

In the particular embodiment illustrated, the eight exit channels 161–168 are positioned to eject eight successively larger coin denominations which is useful in a foreign country such as Germany and England which has an eight-coin coin set. The sorting head 14 could also be configured to have only six exit channels by eliminating two channels such that the U.S. coin set (dimes, pennies, nickels, quarters, half dollars, and dollar coins) can be sorted. This can also be accomplished by using the sorting head 14 illustrated in FIG. 6 with a blocking element placed in two of the exit channels 161–168.

The innermost edges of the exit channels 161–168 are positioned so that the inner edge of a coin of only one particular denomination can enter each channel. The coins of all other denominations reaching a given exit channel extend inwardly beyond the innermost edge of that particular channel so that those coins cannot enter the channel and, therefore, continue on to the next exit channel under the circumferential movement imparted on them by the pad 18. To maintain a constant radial position of the coins, the pad 18 continues to exert pressure on the coins as they move between successive exit channels 161–168.

Each of the exit channels 161–168 includes a corresponding coin sensor S1–S8. The sensors S1–S8 are used to count the coins as the coins exit from the exit channels 161–168. Thus, when the operator of the coin sorter 10 places a batch of coins into the coin tray 12 and performs the necessary functions on the operator control panel 74 to begin the sorting process, the coin sorter 10 has the capability of counting each of the coins in the batch and, thus, determining the monetary value of the batch. The sensors S1–S8 are also included so that the coin sorter 10 can determine the number of coins that have been placed into a particular coin bin 54 to ensure that a coin bin 54 does not become over-filled. In this situation, the coin sorter 10 will instruct the operator via the control panel 74 of the potential overfill problem.

The sensors S1–S8 may be discriminator sensors which determine whether the sensed coin is a slug. If the sensors S1–S8 are discriminator sensors, then they have the capability of both counting each coin and verifying the validity of each coin. Also, if the sensors S1–S8 are discriminator sensors, the system controller must be able to store validity data, such as magnetic patterns, and compare the detected pattern from each coin to the validity data. If a non-authentic coin is detected, the coin sorter 10 may stop immediately and place a message on the control panel 74 which informs the operator of the coin bin 54 that contains the invalid coin. Alternatively coin sorter 10 may finish the coin batch and provide a summary to the operator at the end of the batch.

Referring now to FIG. 3A, the exit channel 164 is representative of all the exit channels 161–168. Exit channel 164 includes a vertical wall 170 which forms a coin relief 172 adjacent to sensor S4. As seen best in FIG. 3, the profile of the vertical wall 170 is curvilinear. As a coin which is sent through exit channel 164 passes by sensor S4, the front edge of the coin moves past the vertical wall 170. Once the trailing edge of the coin passes by the sensor, it falls into the coin relief 172. Because more of the coin will be outside the periphery of the sorter 14 than what remains within the coin relief 172, gravity will cause the coin to fall from the sorter so that it exits into the appropriate coin bin. If the coin relief 172 was not provided, the coin could remain pinched between the coin sorter 14 and the pad 18. Releasing the sensed coin is important to the coin sorter 10 when the rotatable disc 16 comes to a stop since the sensed coin has now been counted by the controller and it is assumed that all sensed coins have been released to the coin bins. In summary, the coin relief 172 ensures that any sorted coin that is counted by a sensor ultimately is released into the appropriate coin bin even though the rotatable disc 16 may be stopped.

FIG. 3A also illustrates a flange 176 that extends around the periphery of the sorting head 14. The flange 176 is for mounting the sorting head 14 onto the unitary base member 30 as is shown best in FIG. 2. The flange 176 of the sorting head 14 fits into the circular recess 36 of the unitary base member 30. The registering structure 178, shown only in FIG. 3, located on the flange 176 fits into a registering notch on the unitary base member 30. Thus, the mating of the male/female connection of the structure 178 and the registering notch guarantees that the sorting head 14 is registered in the proper circumferential position on the unitary base member 30.

Figure 4:
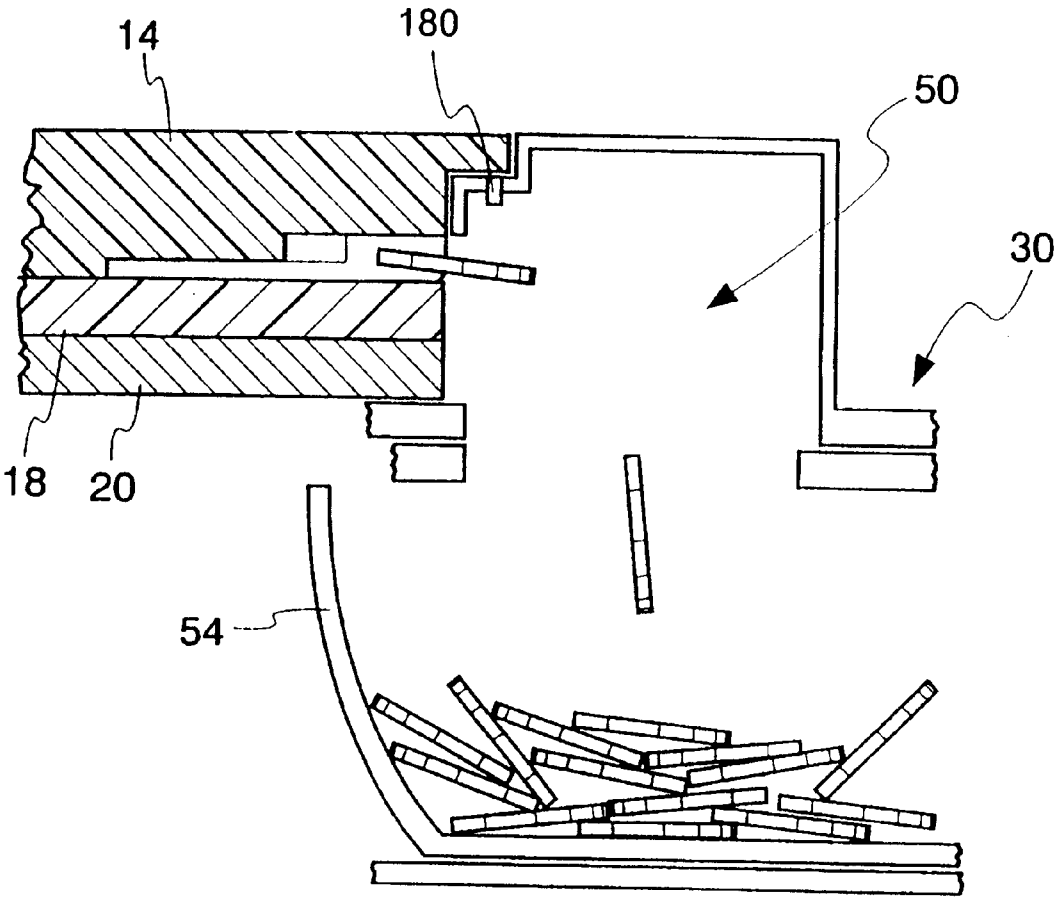
FIG. 4 illustrates the side profile of the coin path when the coins leave the sorting head and are distributed into the coin bins.

In FIG. 4, the coins exit the sorting head 14 and move into the opening of the coin chute 50. The coins then move entirely through the coin chute 50 and exit through an exit aperture of the coin chute 50 whereupon they pass through a hole in an intermediate wall of the coin sorter 10 and encounter the coin bin 54 for that denomination. FIG. 4 also illustrates an alternative embodiment for sensing the coins. The unitary base member 30 is configured with a coin sensor 180 that is located just outside of the sorting head 14. Thus, as the coins for a particular denomination exit from the sorting head 14, the sensor 180 detects the coin as the coin moves into the coin chute 50. Thus, in this alternative embodiment, the sensors S1–S8 illustrated previously are not needed since the sensors 180 in the unitary base member 30 provide all the sensing that is necessary for the coin sorter 10. The sensors 180 can also be discriminator sensors such that they not only count the coins, but they also detect characteristics of the coin which allow the controller for the coin sorter 10 to determine whether a sensed coin is, in fact, an authentic coin.

While only coin bins 54 have been illustrated, the coin sorter 10 may include coin bags instead of the coin bins 54. The coin bags would attach to coin sorter 10 through bag clamping mechanisms which are commonly known in the art.

FIGS. 1–4 illustrate one type of coin sorter 10 which sorts the coins of a particular country into each denomination and provides the operator with the value of the processed coins. Another exemplary coin sorter which uses a rotatable disc and a stationary sorting head is illustrated in U.S. Pat. No. 5,542,880 to Geib et al. which is herein incorporated by reference in its entirety. However, there are several other coin sorting technologies which accomplish this same task.

For example, U.S. Pat. No. 5,525,104, which is assigned to Brandt Inc., discloses another type of coin sorter and is herein incorporated by reference in its entirety. This type of coin sorter utilizes two rotating discs. A first disc aligns the coins into a single file line and transfers the coins to a second disc which sorts the coins by denomination. This type of system is generally described with reference to FIGS. 5–7.

Figure 5:
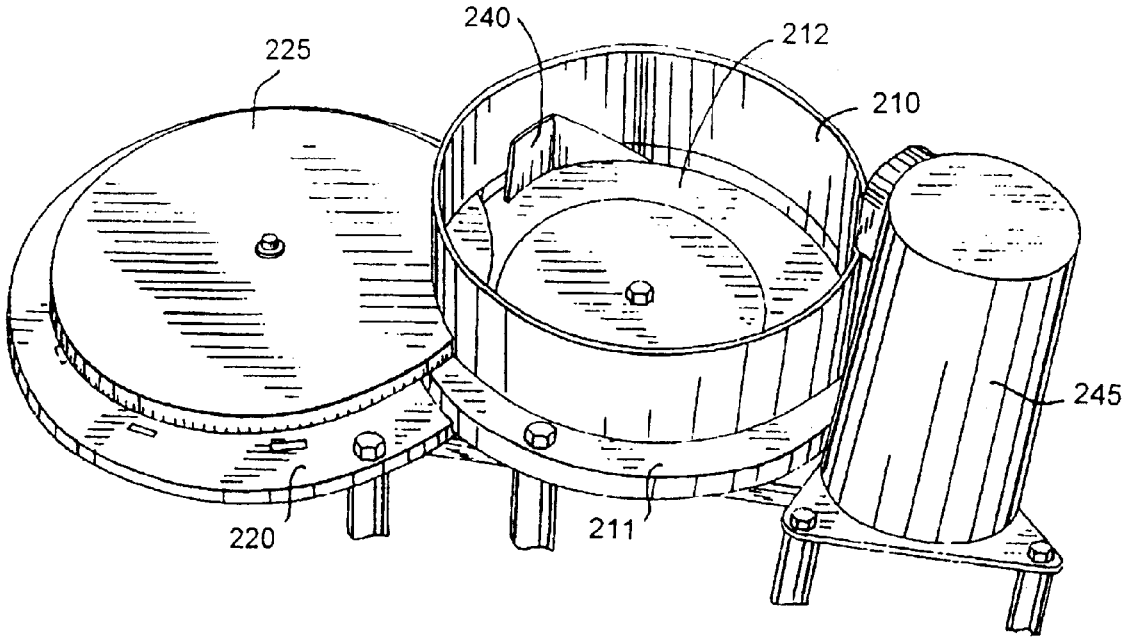
FIG. 5 is a perspective view of an alternative coin sorter having dual rotating discs which can be used in the coin processing system.
Figure 6:
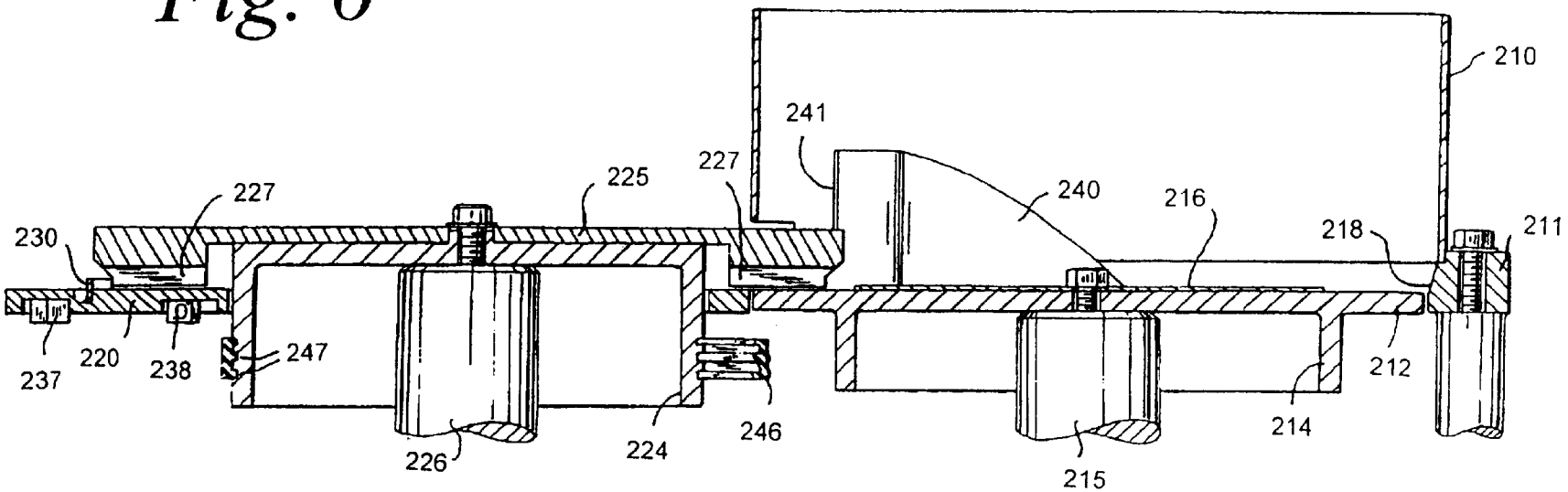
FIG. 6 is a cross-sectional view of the alternative coin sorter of FIG. 5.
Figure 7:
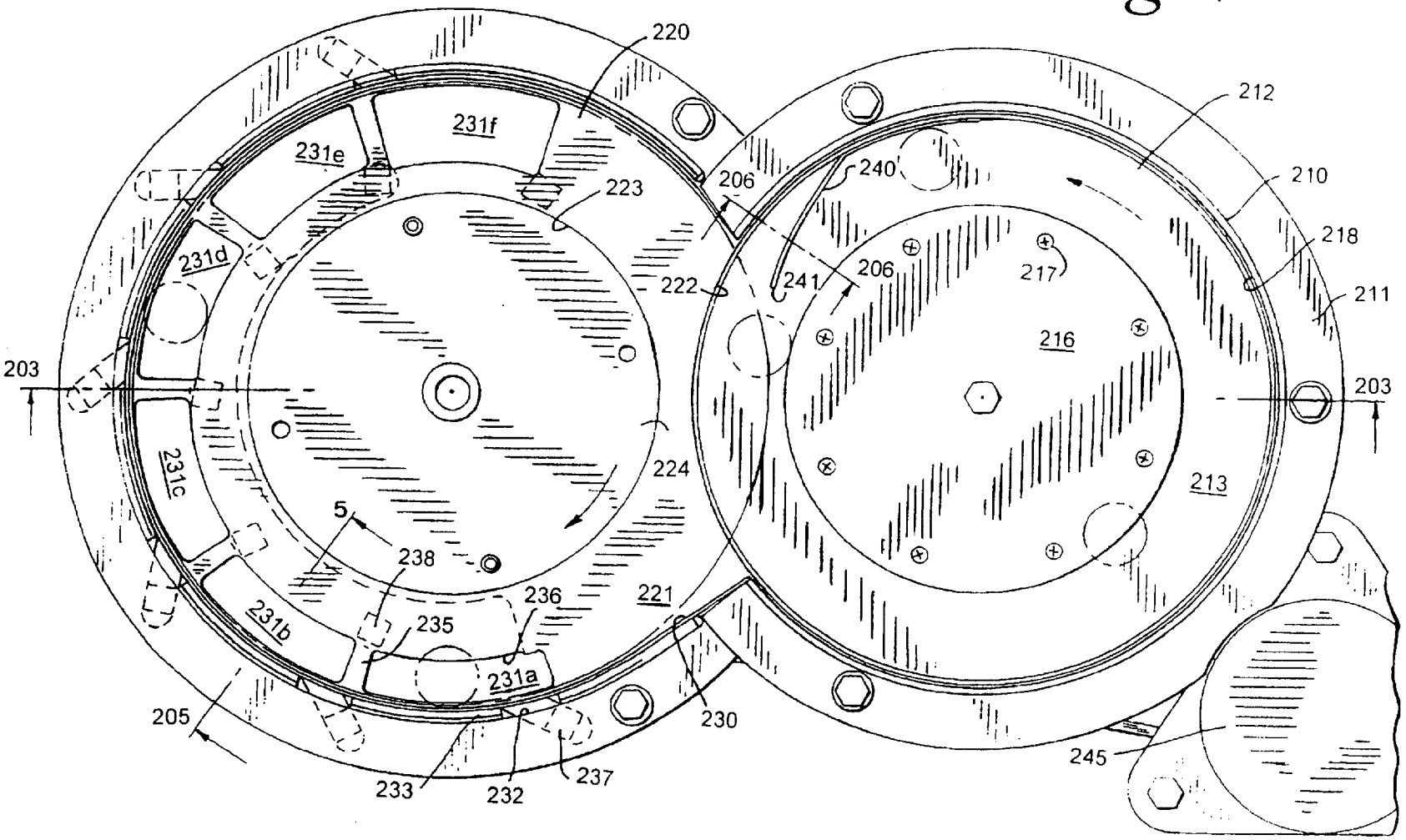
FIG. 7 is a top plan view of the alternative coin sorter of FIG. 5.

In the dual rotating disc system of FIGS. 5–7, mixed coins are deposited in the hopper 210 and upon the rotating hard disc 212. The mechanism works best if a supply of coins is gradually fed to the hard disc 212. The coins on the hard disc 212 will tend to move by centrifugal force to the outer edge of the disc 212 and against the ring 211. The inclined surface 218 on the ring will tend to prevent coins from standing on edge. Single layers of coins will tend to settle between the edge of the plug 216 and the ring 211. The counterclockwise rotating hard disc 212 will move the coins into engagement with the deflector plate 240 which ensures that only a single row of coins will pass its outer end 241. The coins passing the deflector plate 240 will be lying flat upon the upper surface 213 of the hard disc 212. The fingers 227 on the underside of the resilient disc 225 will then engage the upper surface of such coins. The profile of the radial end of the fingers 227 allows coins to be moved beneath the fingers without undue abrasion or distortion of the fingers.

The coins are, in effect, handed off from the rotating hard disc 212 to the rotating resilient disc 225, which is turning at a greater speed. The coins are carried by the fingers 227 from the hard disc upper surface 213 to the upper surface 221 of the sorting plate 220. The coins will encounter the beginning of the upright rim 230 which will urge the coins radially inward as they are carried by the fingers 227 over the surface of the sorting plate 220. Preferably, the entire rim 230 is arranged as a slight spiral so that it encroaches gradually upon the center of rotation of the resilient disc 225 throughout its length. This will cause the coins to be urged tightly against the rim 230 as they are carried through the sorting track. A coin will be carried through the track with its opposite edges resting on the lip 234 and the sorter plate 220 until it encounters an opening 231 for its size. Each coin will be forced through its appropriate opening by reason of the resiliency of the fingers 227, aided by gravity. The passage of each coin through an opening 231 results in a count signal being generated. Consequently, this coin sorting technology results in the discharge of coins of a specific denomination into a coin receptacle below each opening 231.

In yet a different type of coin sorting technology, coins are moved along a track, or rail, and are discharged by pins or holes in the rail, each of which is designed to discharge a coin of a specific diameter. One type of rail sorter configuration is disclosed in U.S. Pat. No. 5,163,868 to Adams et al. which is herein incorporated by reference in its entirety. The essential portions of a rail sorter are generally shown in FIGS. 8 and 9.

Figure 8:
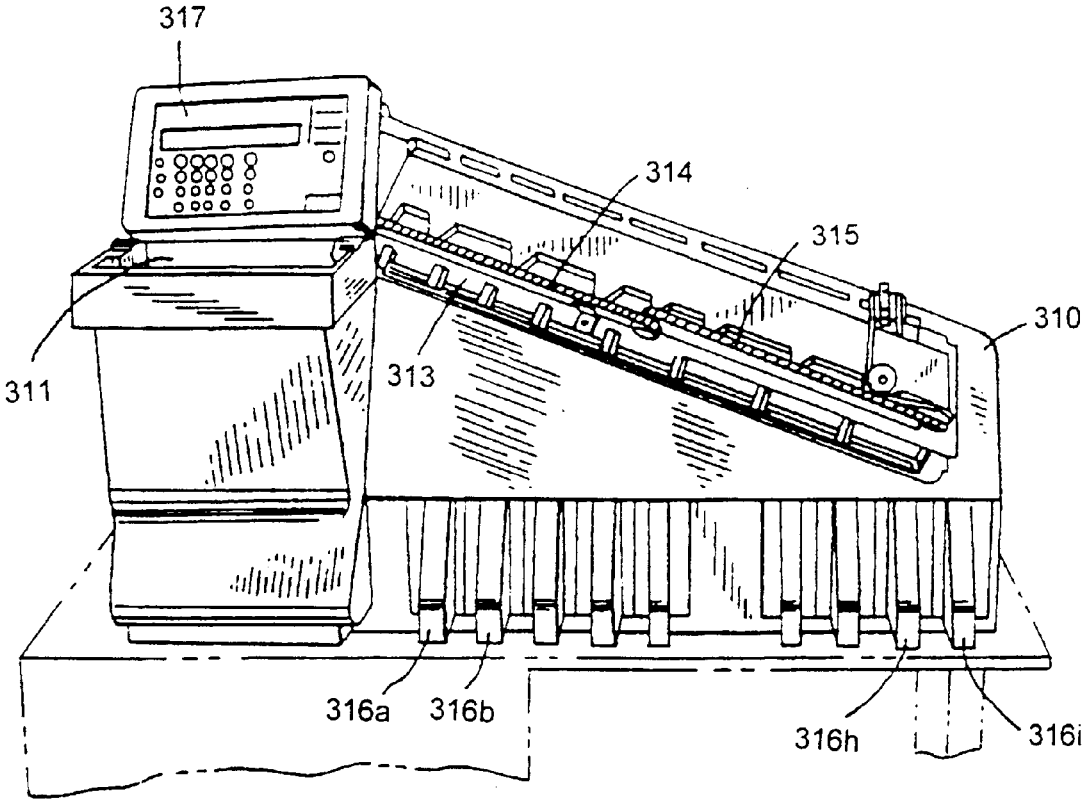
FIG. 8 is yet another type of coin sorter having a rail on which coins are sorted which can be used with the coin processing system.
Figure 9:
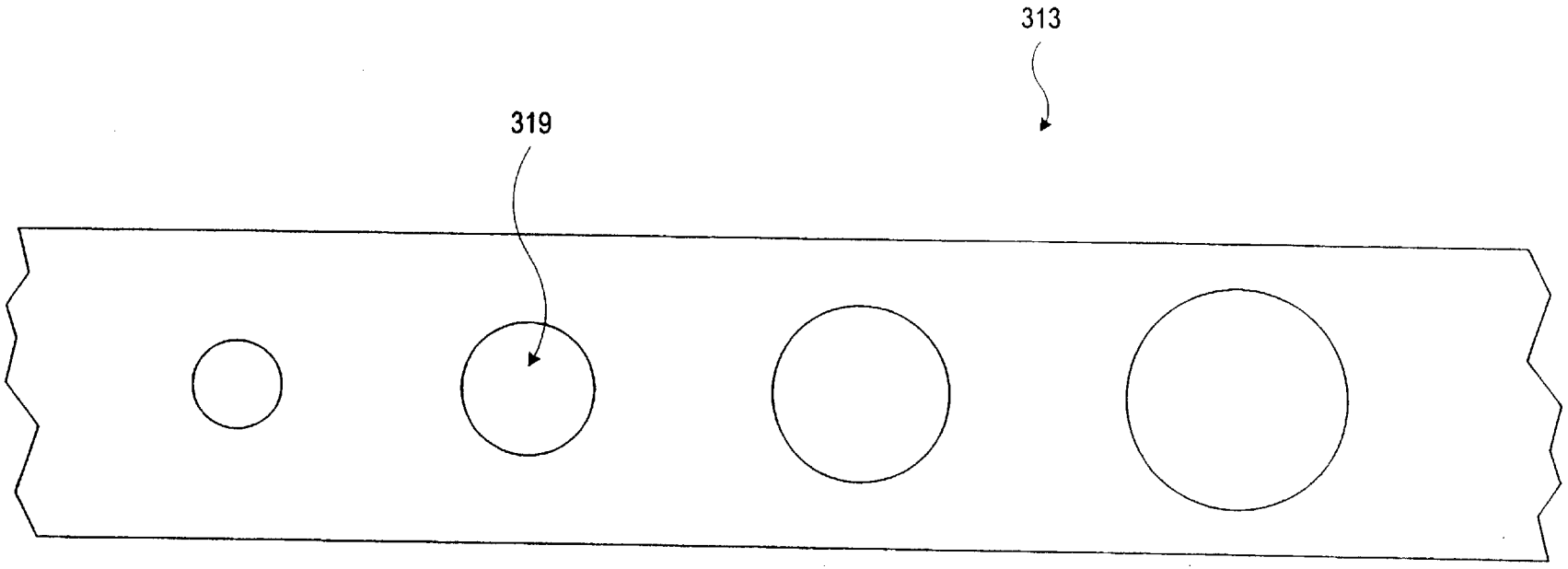
FIG. 9 is a view of a portion of the rail of the coin sorter of FIG. 8.

Referring to FIGS. 8 and 9, a rail-type coin sorter includes a molded housing 310 that has a coin hopper 311 at one end. The hopper 311 leads to a coin feeding mechanism (not shown) which moves coins from the hopper 311 to the entrance of an inclined track, or rail, indicated generally by the numeral 313. The coins are moved along the track 313 by a pair of overlapping continuous belts 314 and 315. As shown best by FIG. 9, as the coins are moved along the track 313, a coin of a specific diameter will pass through an opening 319 in the track 313 having a slightly larger diameter than the coin so that each denomination of coin is deposited through a respective opening 319, down a chute for that size coin, and into one of a series of removable drawers 316*a*–316*i*-disposed in the housing 310 and beneath the inclined track 313. A control panel 317 is hinged to the housing 310 and normally covers the coin feeding mechanism 312, as shown in FIG. 8. Thus, a batch of mixed coins are sorted, counted, and placed into removable drawers. 316*a*–316*i* by the rail coin sorter.

Figure 10:
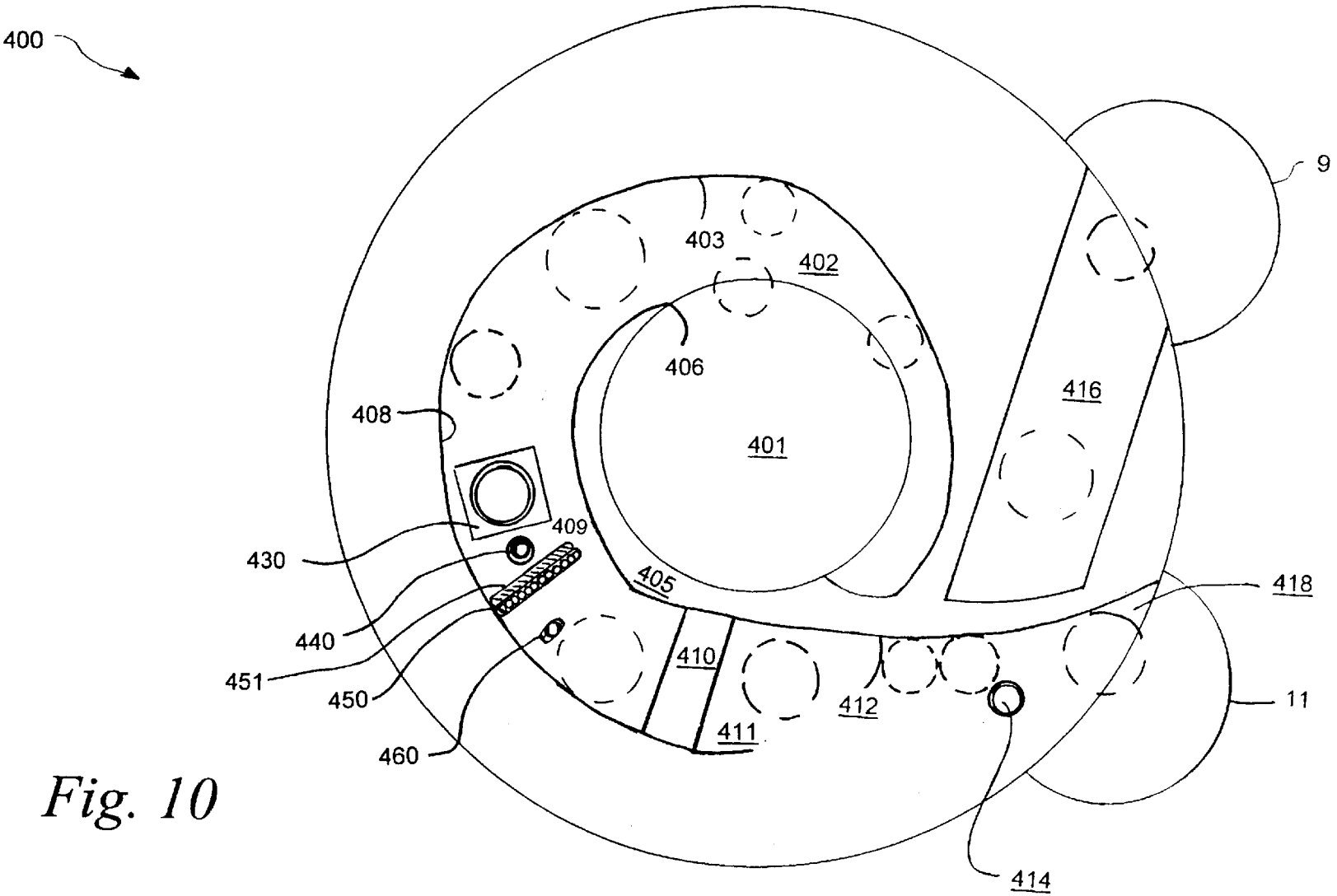
FIG. 10 is a bottom view of one discrimination head used in the coin loader.

As can be seen in FIG. 10, the two coin sorters 10 illustrated in FIG. 1 can be designed in various ways to sort a batch of mixed coins into their denominations. Consequently, the coin processing system 5 is not limited to merely one type of coin sorter but encompasses a variety of coin sorters which can be used in conjunction with the coin loader 6.

With reference now to FIG. 10, the coin loader 6 includes a discrimination head 400. The discrimination head 400 has at its center an opening 401 into which coins are deposited through the coin tray of the coin loader 6 shown in FIG. 1. A resilient rotatable pad, which is not shown, is concentrically aligned with the discrimination head 400 and spaced away from the lower surface of the discrimination head 400, the surface which is shown in FIG. 10. In other words, the discrimination head 400 and the pad are arranged in a similar fashion as the sorting head 14 and rotatable disc 16 shown in FIG. 2. The discrimination head 400 remains stationary as the rotatable disc positioned therebelow imparts motion on the coins as they are deposited through the opening 401.

As the coins are deposited through the opening 401 of the discrimination head 400, the rotation imparted upon them by the rotatable disc 16 causes the coins to enter an entry channel 402 which is defined by an entry wall 403. A blocking surface 405 is positioned opposite of the entry channel 402 and is actually a part of the lowermost surface of the discrimination head 400. The lowermost surface is spaced away from the rotatable disc by a distance that is less than the thickness of the thinnest coin to be processed. Thus, the coins can only enter into the entry channel 402 and move radially outward therefrom and circumferentially in the counterclockwise direction as shown in FIG. 10. The coins which move past the leading end 406 of the blocking surface 405 are not under any pressure from the pad and move outwardly onto the queuing wall 408 due to centrifugal force. As the coins move along the queuing wall 408, which merges smoothly with the entry wall 403, they encounter a sensing region 409 which contains a plurality of sensors which will be described later. The coins moving through the sensing region 409 are not under any pressure from the pad but instead are moving along the queuing wall 408. However, in an alternative embodiment, the sensing region 409 can be a shallow channel such that coins are in pressed engagement with the rotatable disc thereby causing the disc to have more control of the coins.

As the coins move along the sensing region 409, they encounter a ramp 410 leading down to a gauging area 411 which is defined by an inner wall 412. In the gauging area 411, the coins are under pad pressure such that once they have move beyond the ramp 410, their direction in the radial direction is limited as the pressure of the pad causes them to move only in the circumferential direction until they hit the inner wall 412. Once the cons engage the inner wall 412, they continue moving outwardly toward a pin 414 which is controlled usually by a solenoid which is not shown. When the pin 414 is in its extended position (i.e. extending downwardly from the discrimination head 400 toward the rotatable disc), no coins can move past it as the coins move radially outward along the inner wall 412 of the gauging area 411. Thus, the coins are forced to move across the inner wall 412, which is slightly angled, and into the first exit channel 416. Once the coins are in the exit channel 416, they are moved radially outward towards the periphery of the discrimination head 400 until they are deposited in the first coin chute 9 (shown in FIG. 1).

Alternatively, if the coins are moving along the inner wall 412 of the gauging area 411 and the pin 414 is in the retracted position, the coins continue to move through the gauging area 411 and encounter the second exit channel 418, which is essentially an extension of the gauging area 411. Coins which enter into the second exit channel 418 are then deposited into the second coin chute 11 (shown in FIG. 1). Thus, any coin which enters the discrimination head 400 either moves into the first coin chute 9 or the second coin chute 11.

While the pin 414 is described as being moveable in the vertical direction, it can also be moved laterally into a deflecting position. Thus, the pin 414 would move in a slot in the discrimination head 400 between a coin-engaging position which forces coins into the first exit channel 416 and a retracted position where coins are free to move into the second exit channel 414.

The primary function of the discrimination head 400 is to determine the type of coin that is being processed and control the entry of that coin into either the first coin chute 9 or the second coin chute 11 based on that determination. Thus, the sensors that are present in the sensing area 409 serve the purpose of determining the types of coin that are being processed by the discrimination head 400.

A coin imaging sensor 430 is the first sensor which the coins encounter. The coin imaging sensor 430 emits light as the coins pass thereacross and senses the reflected light from that coin. The reflected light is in a pattern that creates an image which is captured by the coin imaging sensor 430. The coin imaging sensor 430 then sends the pattern to a controller for the coin loader 6 which has stored patterns of images for every possible coin that the coin loader 6 will encounter. The controller then compares the detected image from the coin imaging sensor 430 with that of the stored images and determines which type of coin is passing across the coin imaging sensor 430. If the controller determines that the coin passing across the coin imaging sensor 430 is from a first currency (a coin from Country A), then the controller will actuate the pin 414 such that the pin 414 is in its extended position which forces that coin into the first exit channel 416. On the other hand, if the controller determines from the image provided by the coin imaging sensor 430 is that of a coin from a second currency (a coin from Country B), then the controller will maintain the pin 414 in the retracted position such that that coin moves into the second exit channel 418 and is sent into the second coin chute 11.

As can be seen in FIG. 10, there is a significant distance between the coin imaging sensor 430 and the pin 414. Thus, the controller has a predefined period of time to determine what type of coin has been sensed and whether the pin 414 should be actuated. Because the rotatable disc imparting the motion on the coins is running at a constant angular speed, the amount of time that it takes a coin to move from the coin imaging sensor 430 to the pin 414 can be easily calculated. Furthermore, since the rotatable disc often includes an encoder which is monitored by an encoder sensor to determine the exact position of the rotatable disc relative to the discrimination head 400, the position of the sensed coin can be tracked by monitoring the encoder. Thus, the precise time to actuate the pin 414 is known.

In the worst possible scenario, two coins from two different countries are aligned along the inner wall 412 back-to-back with their edges engaged adjacent to the pin 414 as is shown in FIG. 10. While the position of each of these coins adjacent to the pin 414 is known by the controller, the time period during which the controller must actuate the pin 414 is the time that it takes the leading edge of the trailing coin to move to the pin 414 immediately after the trailing edge of the lead coin has moved beyond pin 414. The details of one type of coin imaging sensor 430 will be described in more detail in FIGS. 12–16.

Next to the coin imaging sensor 430 is a magnetic sensor 440 that is used to determine the metal content of each coin that passes thereby. The magnetic sensor 440 detects a magnetic pattern which is sensed by the controller of the coin loader 6. The magnetic pattern produced by the magnetic sensor 440 is then compared to stored patterns in the controller. Upon making this comparison, the controller then determines which type of coin is being sensed by the magnetic sensor 440. Often, coins from one country will have a specific metal content such that the magnetic patterns for each of the coins in the coin set are similar. Thus, the magnetic sensor 440 provides another method by which the controller can determine which type of coin can be sensed and determine whether the pin 414 requires actuation. While there are various sensing systems which can determine the metal content of the coins, one type of sensor is described below with reference to FIGS. 28–31.

A coin diameter sensor 450 also resides within the sensing region 409. In one embodiment, the coin diameter sensor 450 includes a bank of optical sensors which sense the light that is reflected off the coin as it passes by. Thus, the coin diameter sensor 450 includes an optical light source 451 which produces light once the leading edge of the coin is detected. The light produced by the optical light source 451 is reflected off the surface of the coin and detected by the coin diameter sensor 450. Preferably, the coin diameter sensor 450 has several hundred pixels per inch such that when a coin passes thereacross, only a given number of pixels will receive the reflected light from the coin. Because the coin diameter sensor 450 has excellent resolution due to the number of pixels, slight differences in the diameters of coins can be detected. One example of this type of sensor is the model TSL 218 manufactured by Texas Instruments which has approximately 200 pixels per inch. The number of pixels which detect this reflected light corresponds to the diameter of the passing coins since each coin that passes by the coin diameter sensor has its outer edge at a known radial position (i.e. along the queuing wall 408). Consequently, the controller determines which type of coin is passing across the coin diameter sensor based on the number of pixels which receive reflected optical energy from the passing coin. The controller then determines whether the pin 414 should be actuated based on the comparison with the stored values for diameters contained within the controller's memory. Other coin diameter sensors will be discussed with reference to FIGS. 17–27.

Lastly, a coin thickness sensor 460 is also located in the sensing region 409. Because different coins often have different thicknesses, the controller of the coin loader 6 determines the type of coin by determining the thickness of the passing coin. The coin thickness sensor 460 can be a small probe that protrudes down from the discrimination head 400 into the sensing region 409, and moves upwardly a specific distance when a specific coin engages it. Thus, the controller detects the upward movement of the probe and determines which coin has caused this movement in the probe. Other types of coin thickness sensors utilize a coil which receives a specific electromagnetic signal based on the specific diameter of the coin. Once the controller of the coin loader 6 determines the thickness of the coin that is being sensed by the coin thickness sensor 460, the controller can then determine whether to actuate the pin 414.

Figure 11:
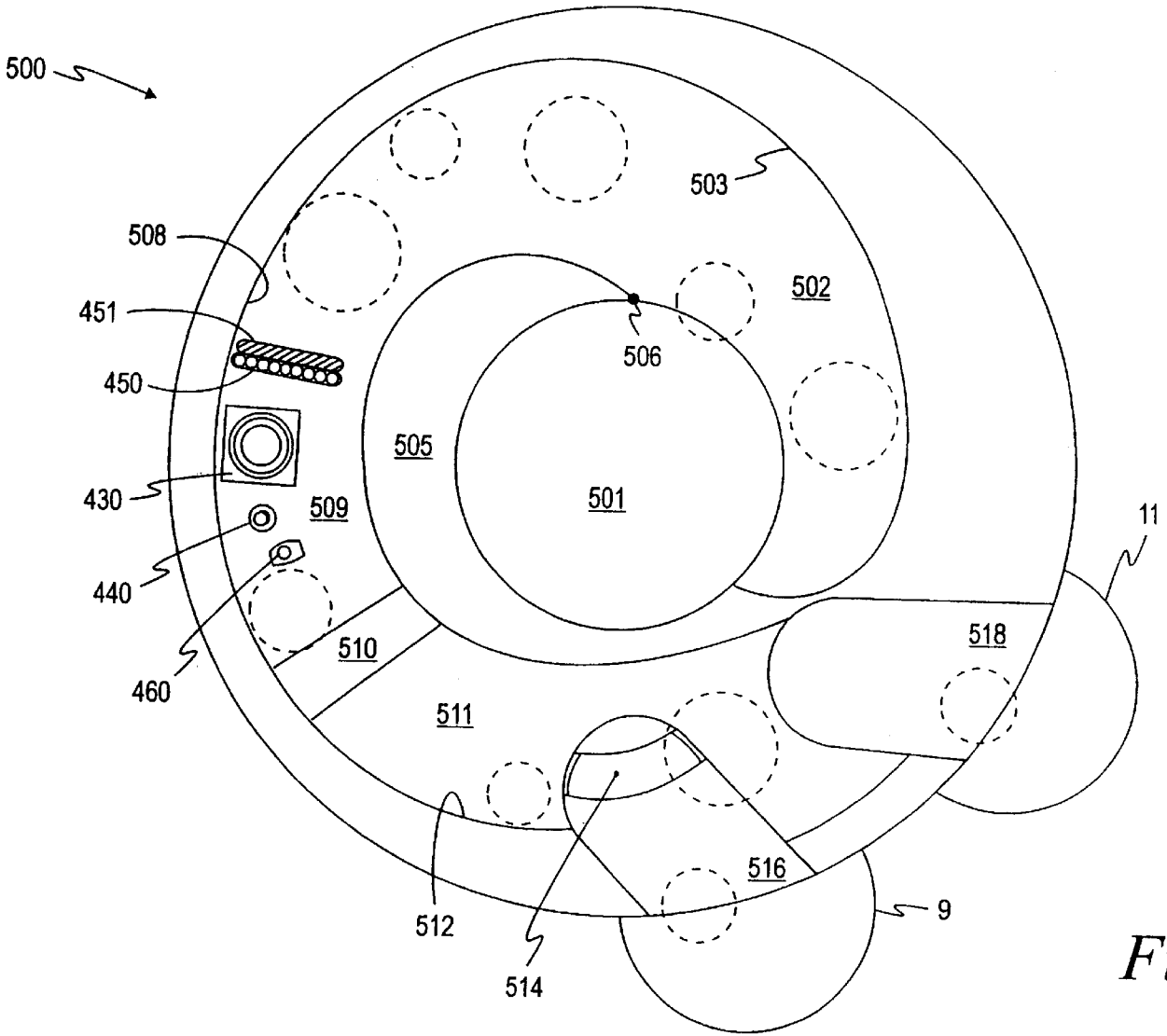
FIG. 11 is a bottom view of an alternative discrimination head used in the coin loader.
Figure 12:
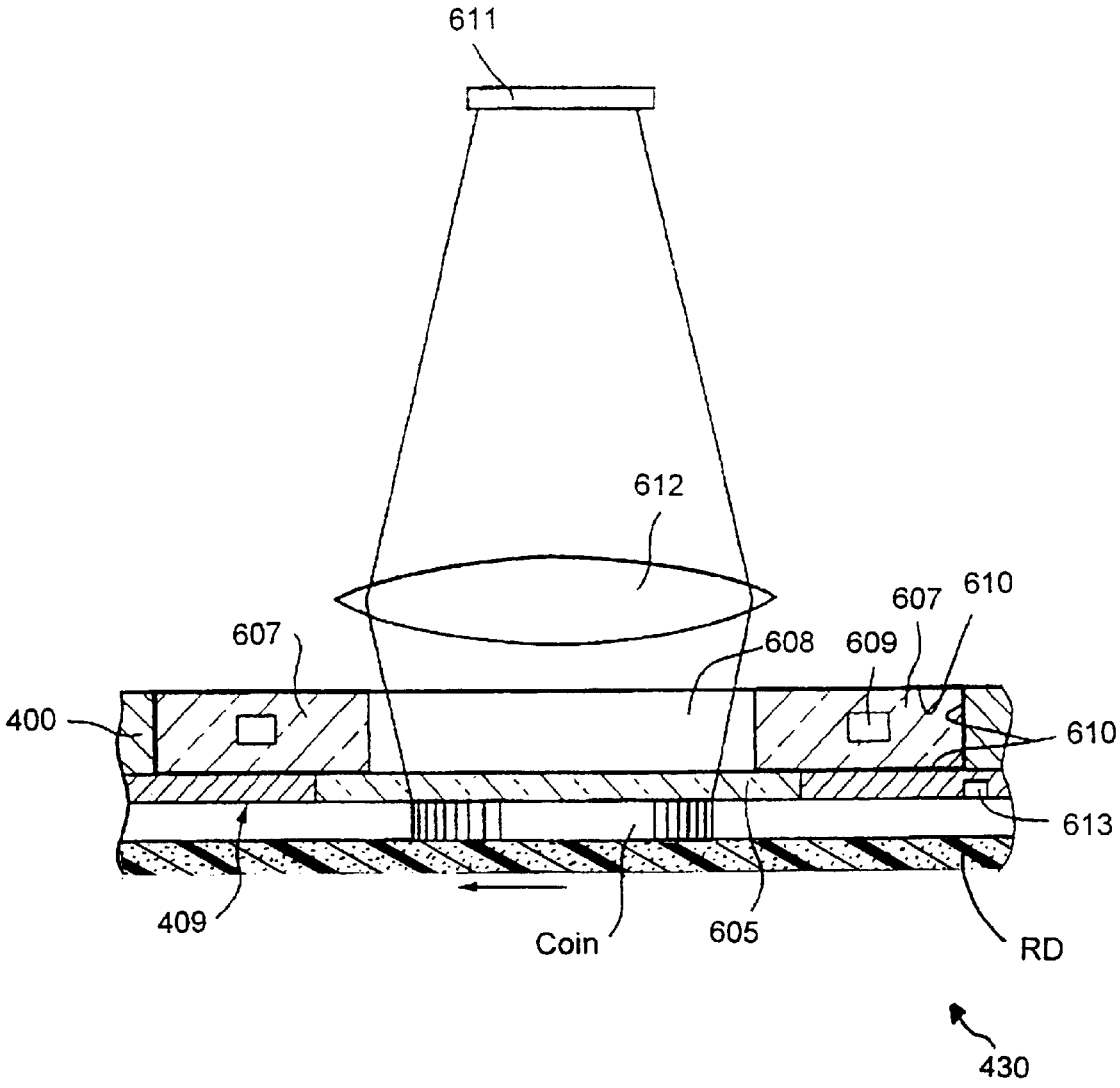
FIG. 12 is a cross-sectional view of one type of coin imaging sensor that can be used in the coin loader.
Figure 13:
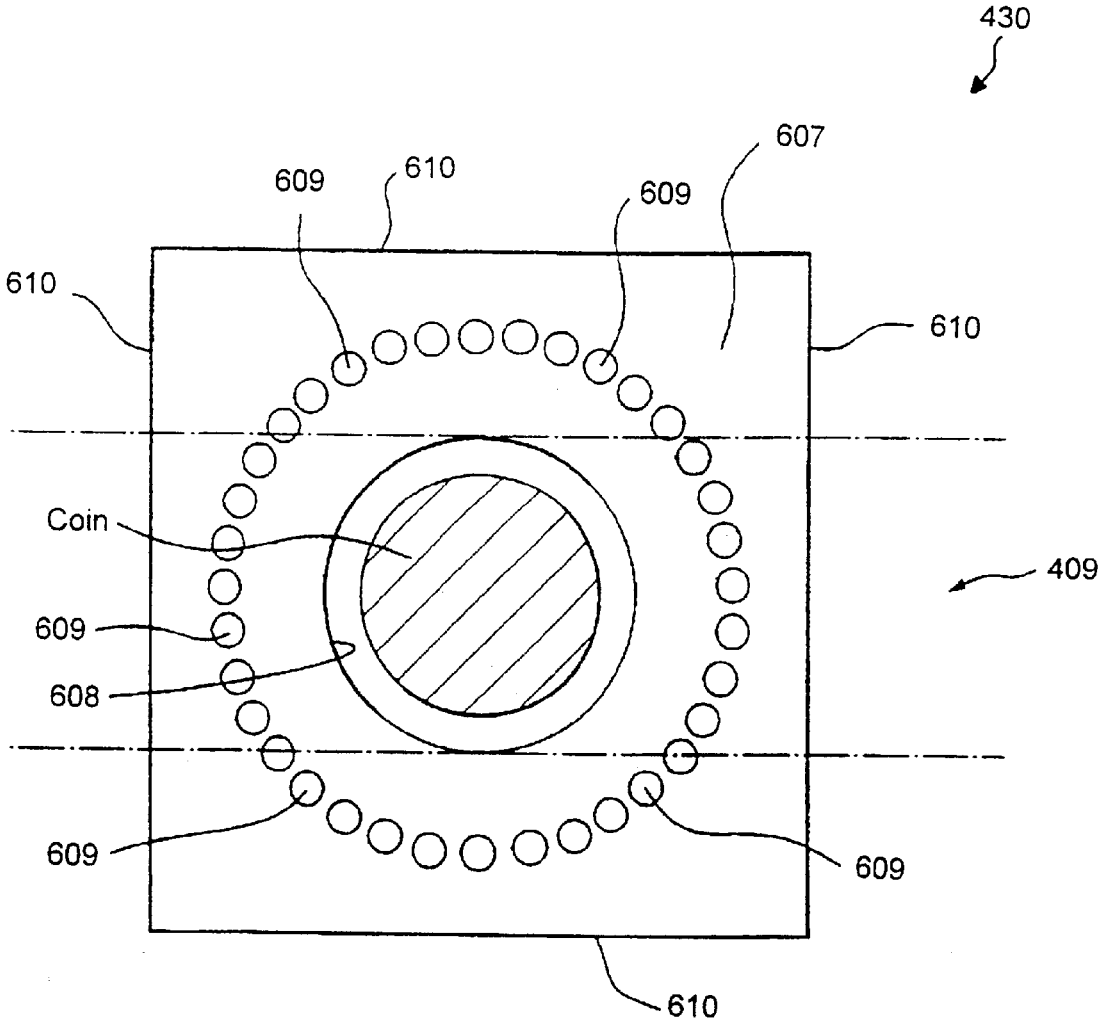
FIG. 13. is a bottom view of the coin imaging sensor of FIG. 12.
Figure 14:
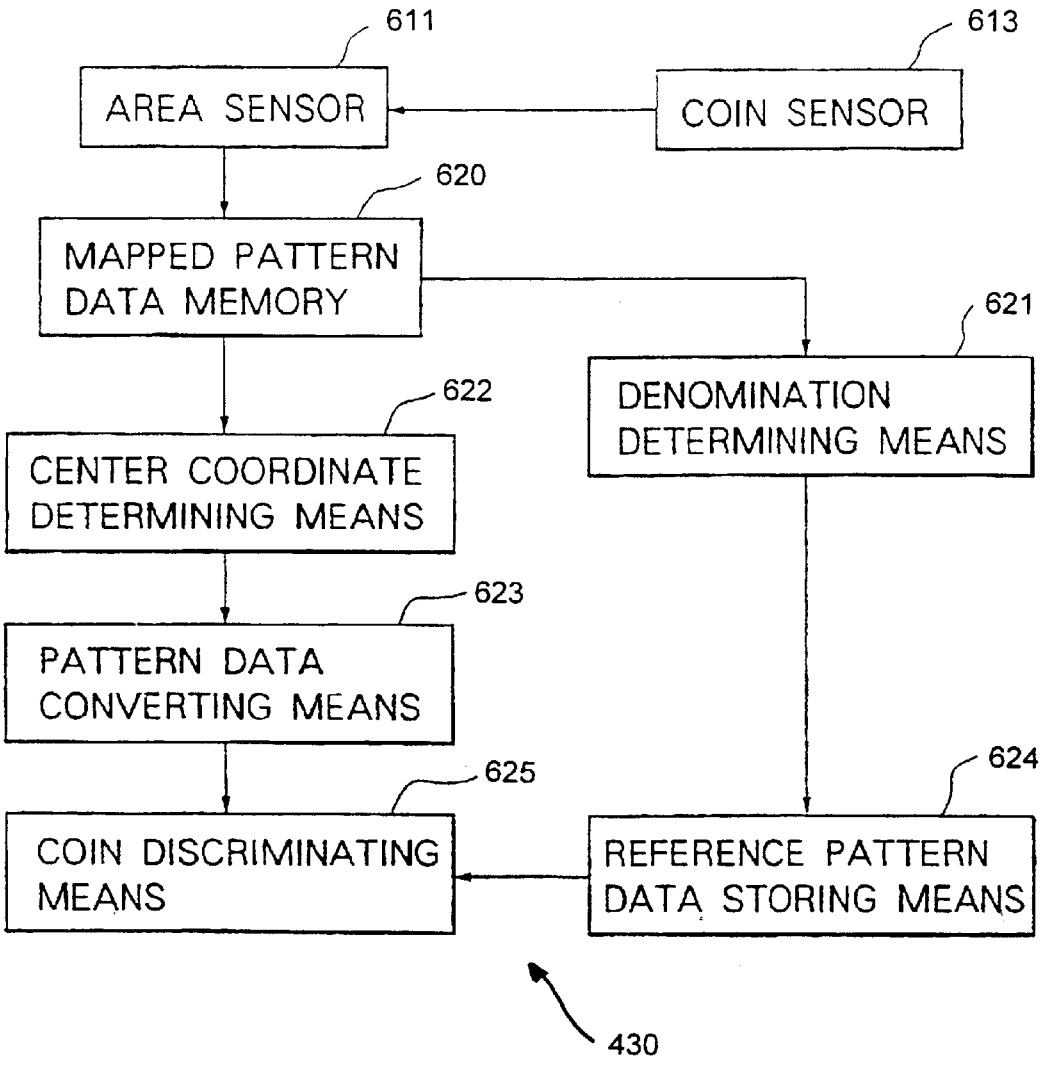
FIG. 14 is a schematic showing the operation of the coin imaging sensor of FIG. 12 in the coin loader.

In FIG. 11, an alternative discrimination head 500 is illustrated. The discrimination head 500 includes an opening 501 into which coins enter after they are deposited in the coin tray of the coin loader 6 shown in FIG. 1. The coins move outwardly from the opening 501 into an entry area 502 which is defined by an outer entry wall 503. Opposite the entry area 502 is a blocking surface 505, which is actually a part of the lowermost surface of the discrimination head 500. Accordingly, the blocking surface 505 prohibits all coins from moving radially outwardly into this area. Thus, the coins must move beyond the lead end 506 of the blocking surface 505 into the entry region 502 toward entry wall 503.

After the entry area 502, the coins move radially outward against a queuing wall 508 which leads into a sensing region 509. The queuing wall 508 smoothly merges into the entry wall 503. As the coins move into the sensing region 509, they are not under any pressure from the rotating pad positioned below the discrimination head 500. Thus, they are free to move radially outward against the queuing wall 508 under the centrifugal force imparted upon them by the rotating disc.

Once the coins have moved across the sensors in the sensing region 509, the coins move across a ramp 510 which leads down to a gauging area 511. The gauging area 511 is defined by an inner wall 512 which decreases in radius in the counterclockwise direction, the direction in which the coins are moving. The coins are under the pressure of the pad while in the engaging region 511 and, thus, their radial movement is limited not only by the wall 512, but also due to the fact that they are pinched between the pad of the rotating disc and the gauging region 511.

The coins moving through the gauging region 511 encounter a shoe 514 which bridges the first exit channel 516. If the shoe 514 is in the downward position, its lower surface is in the same plane as the surface of the gauging region 511. Thus, coins move freely across it as if the shoe 514 were a part of the gauging region 511. Coins moving in this manner move into the second exit channel 518. Any coins moving into the second exit channel 518, which is large enough to accommodate all coins to be sorted, enter the second coin chute 11 which is shown in FIG. 1.

Alternatively, if the shoe 514 is in its retracted position, its lower surface is in the same plane as the surface defining the first exit channel 516. Thus, all coins which move toward this first exit channel 516 will enter into the first exit channel 516 if the shoe 514 is in its retracted position. Due to the depth of the first exit channel 516, the coins then cannot move any further circumferentially toward the second entry channel 518 and, thus, move outwardly toward the periphery of the discrimination head 500 and enter into the first coin chute 9.

The relationship between the shoe 514 and the controller which senses the sensors 430, 440, 450, and 460 is generally the same as that of the pin 410 to the controller as described previously with respect to FIG. 10. Thus, as the controller extends the shoe 514, coins move across the shoe 514 and enter the second exit channel 518. If the shoe 514 is retracted, coins then must move into the first exit channel 516. With regard to the precise timing of the actuation of the shoe 514 when two coins from two countries are aligned back-to-back, the controller must wait until a coin that is to be guided into the second exit channel 518 has at least a portion of its leading edge on the gauging surface 511 between the first and second exit channels 516 and 518 before retracting the shoe 514 to force the trailing coin into the first exit channel 516. Because the coins are under pad pressure pinched between the pad and the gauging surface 511, once the leading edge of a coin is on the gauging surface 511 between the first and second exit-channels 516 and 518, there is no chance the coin will fall back into the first exit channel 516 when the shoe 514 is retracted and released from engagement with that coin. If the lead edge of the trailing coin is on the shoe 514 when the shoe 514 is retracted, then the lead edge of that coin will be forced toward the surface defining exit channel 516 by the resiliency of the pad which is applying pressure to the coin in that direction. Thus, the trailing coin will be outsorted into the first coin chute 9. Conversely, if the lead coin is to enter the first coin chute 9, then the controller must wait until it has passed the shoe 514 within the first exit channel 516 before actuating the shoe 514 to move it into the same plane as the gauging surface 511 which allows the trailing coin to move to the second exit channel 518.

In contrast to discrimination head 400, the coins in the discrimination head 500 are not aligned on their internal surface as they are acted upon by an exterior pin or shoe, but instead on their outer edges (i.e. along the gauging wall 512). Consequently, the discrimination head 500 presents another option in which coins from a first currency (Country A) and second currency (Country B) are discriminated and transferred to the first coin chute 9 and the second coin chute 11, respectively.

While the discriminator heads 400 and 500 of the loader 6 have been illustrated as circular discs with diverting mechanisms, it is also possible to move the coins along a straight rail (like the rail sorter of FIGS. 8 and 9) and sort the coins into the coin set of Country A and the coin set of Country B. The discriminating sensors, 450, and 460 would be placed upstream of the diverting mechanism on the coin track. Just as described with reference to FIGS. 10–11, the controller would actuate the diverting mechanism in response to signals received by the sensors 430, 440, 450, and 460. Additionally, the loader 6 could use the dual rotating disc technology illustrated in FIGS. 5–7 to align the coins in a single stream on the first rotating disc, detect the characteristics of the coins with the sensors 430, 440, 450, and 460 and actuate a diverting mechanism to move the coins into one of two openings in the second rotating disc.

In FIGS. 10 and 11, the discrimination heads 400 and 500 have been described as having four separate sensors, a coin imaging sensor 430, a magnetic sensor 440, a coin diameter sensor 450, and a coin thickness sensor 460. The circumferential positioning of these sensors is not critical to the invention as is illustrated by the fact that the coin imaging sensor 430 is shown as the first sensor which engages the coins in FIG. 10 while the coin diameter sensor 450 is shown as the first sensor to engage the coins in FIG. 11. Depending on the two coin sets from the two countries that are to be separated in the coin loader 6, it may be only necessary to include one of these four sensors. For example, if each of the coins in the two coin sets (Country A and Country B) has a diameter which is at least slightly different from the diameters of the remaining coins in those two coin sets, then it is possible to discriminate between all of the coins in the two coin sets by only using a coin diameter sensor 450. Such a configuration is also possible if each coin in the two coin sets for Country A and Country B has at least a slightly different thickness than the remaining coins in those coin sets such that only a thickness sensor 460 is necessary to discriminate between all of the coins in the two coin sets. Additionally, if the metal content of the coins of Country A is slightly different than the metal content for the coins of Country B, then only the magnetic sensor 440 may be needed to discriminate between the coins from Country A and coins the from Country B. In fact, because of the detailed imaging provided by the coin imaging sensor 430, it is possible to use only the coin imaging sensor 430 to discriminate between the coins from Country A and the coins from Country B even though one coin in each set has the same diameter and the same thickness, assuming that the designs (or surface irregularities) on these two coins are different. In these embodiments, the three other sensors not required can be removed from the discrimination head 400 or 500.

In an alternative embodiment, neither one nor four sensors are used to discriminate between coins from Country A and coins from Country B, but instead two of the four coin sensors are used. For example, if one coin in each of the two coin sets has substantially the same diameter, but different thicknesses, then the controller for the coin loader 6 can take the information sensed by the coin diameter sensor 450 and the coin thickness sensor 460 and determine the chute 9 or chute 111 into which each of the coins with the same diameter must be transferred. In other words, if all of the coins in the two coin sets have different diameters except for two coins (one from Country A and one from Country B), then the characteristic that the controller detects to determine whether those coins should be sent to the first or second chute is the thickness.

In summary, although four coin sensors have been illustrated in each of the discrimination heads 400 and 500, it is possible to perform the necessary discrimination with only one, two, or three of these sensors.

With regard to the details of the coin imaging sensor 430, there are several methods in which the coin loader 6 can detect the image of each coin that passes by the coin imaging sensor 430. One such method is disclosed in U.S. Pat. No. 5,494,147 which is herein incorporated by reference in its entirety and will be generally described with references to FIGS. 12–16.

In FIGS. 12–16, when a coin is fed through the sensing region 409 and the coin sensor 613 detects that the coin has reached a prescribed position on the transparent plate 607, light is projected onto the back surface of the coin from the plurality of light emitting elements 609. The emitted light is reflected by the back surface of the coin and is focused by the convex lens 612 to enter the area sensor 611. Since the plurality of light emitting elements 609 are arranged in the transparent plate 607 and the hole 608 of the transparent plate 607 is arranged immediately below the coin to be discriminated such that the circumferential surfaces thereof are positioned outside of the coin to be discriminated, light is projected onto the back surface of the coin at a shallow angle with respect to the back surface of the coin and light is reflected by the back surface of the coin in accordance with the surface irregularities constituting the pattern thereof and is received by the area sensor 611.

The area sensor 611 produces pattern data in accordance with the intensity of received light, namely, the pattern irregularities of the surface of the coin. Of course, the coin may have a different design or irregularities on the front and back surface of the coin and the controller of the coin loader 6 must be able to recognize both of them. Since the reflection members 610 are provided on the inner surfaces of side portions and upper and lower inner surfaces of the transparent plate 607, light is uniformly emitted from the transparent plate 607 with uniform intensity and reflected by the back surface of the coin. Therefore, if the denomination is the same, the same pattern data will be produced by the area sensor 611.

Figure 15:
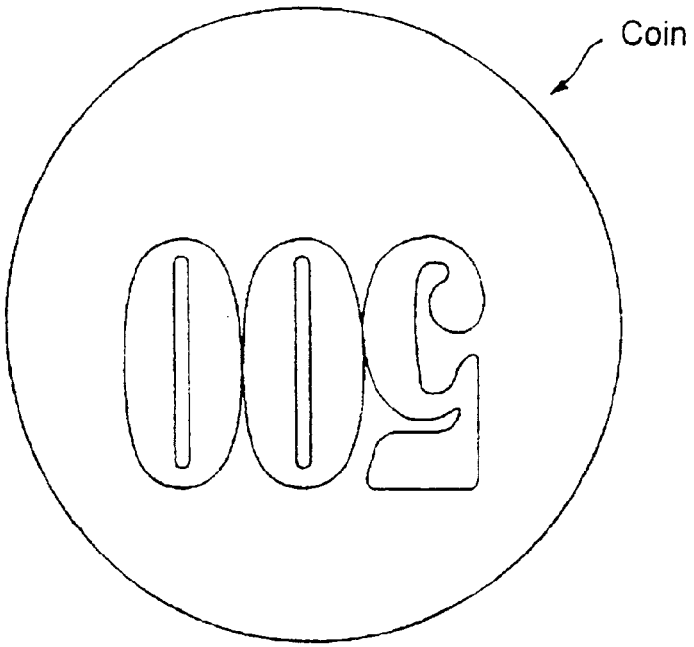
FIG. 15 is a view of a typical coin imaged by the coin imaging sensor.

The pattern data produced by the area sensor 611 is mapped in the x-y coordinate system and stored in the mapped pattern data memory 620. FIG. 15 shows one example of pattern data of a coin produced by the area sensor 611 and mapped and stored in the mapped pattern data memory 620.

The controller for coin loader 6 has various processing algorithms stored therein to determine the type of coin being sensed. The denomination determining means 621 calculates the outer diameter of the coin based on the pattern data of the coin mapped in the x-y coordinate system and stored in the mapped pattern data memory 620 and tentatively determines the denomination of the coin, thereby producing a denomination signal which is sent to the reference pattern data storing means 624.

On the other hand, the center coordinate determining means 622 determines the center coordinates (xc, yc) of the pattern data of the coin based upon the pattern data of the coin mapped in the x-y coordinate system and stored in the mapped pattern data memory 620. The center coordinate determining means 622 then outputs it to the pattern data converting means 623.

Figure 16:
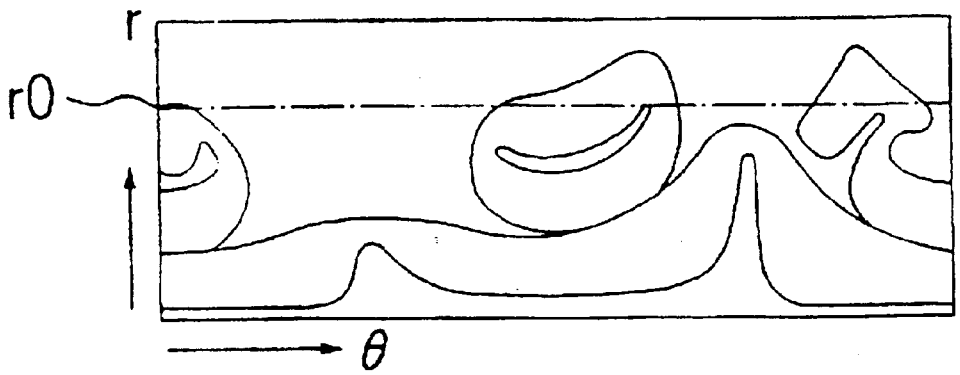
FIG. 16 is a view of the coin image in FIG. 15 after it has been converted to an r-Ø coordinate system.
Figure 17:
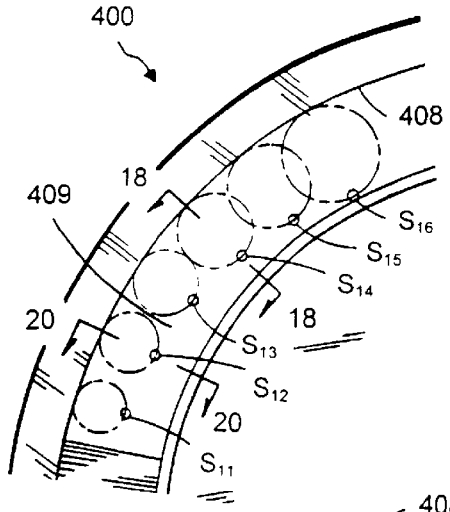
FIG. 17 illustrates an alternative coin diameter sensing mechanism that can be used in the discrimination heads of FIGS. 10 and 11.

Based on the center coordinates (xc, yc) of the pattern data of the coin input from the center coordinate determining means 622, the pattern data converting means 623 transforms the pattern data of the coin mapped in the x-y coordinate system and stored in the mapped pattern data memory 620 into an r-Ø coordinate system. FIG. 16 shows the converted pattern data thus transformed into the r-Ø coordinate system.

Based upon the denomination signal input from the denomination determining means 621, the reference pattern data storing means 624 selects the reference pattern data of the reverse surface of the coin corresponding to the denomination from among the reference pattern data mapped into the r-Ø coordinate system which are stored therein. The reference pattern data is then sent to the coin discriminating means 625.

Since the pattern data cannot be produced by the area sensor 611 with the coin in a predetermined angular orientation and the coin is normally offset angularly from the coin used for producing the reference pattern data, the converter pattern data is normally offset along the abscissa, namely, the Ø axis shown in FIG. 16, with respect to the reference pattern data. Therefore, it is necessary to correct the deviation of the converted pattern data in the Ø direction and discriminate the coin by comparing the converted pattern data with the reference pattern data.

Accordingly, the coin discriminating means 625 reads the pattern data values of the converted pattern data shown in FIG. 16 over 360 degrees whose ordinate values are equal to a predetermined value R0 and reads the pattern data values of the reference pattern data shown over 360 degrees whose ordinate values are equal to a predetermined value R0. The coin discriminating means then corrects the pattern value by adjusting its position on the R-Ø axis so that the predetermined values R0 of the pattern value and the reference pattern data are aligned. The coin discriminating means 625 then compares the corrected pattern values with the reference values to determine whether the type of coin that is being sensed is of the denomination initially chosen by the denomination determining means 621. If it is not, a new denomination is chosen which has a similar diameter to the coin that was initially selected. The comparison is then run again to attempt to match the scanned image to the reference pattern data for the newly selected coin. This process is continued until a match is found for the scanned coin.

There are several other methods by which the coins can be imaged. For example, the method described previously has been improved such that coin imaging sensor 430 and the process for comparing the images takes into account the fact that dust or debris may be attached to the coin. Such an improvement is described in European Patent Application EP 798 669 A2, which is herein incorporated by reference in its entirety. Other coin imaging systems are disclosed in U.S. Pat. Nos. 5,346,049 and 5,576,825, which are herein incorporated by reference in their entireties.

With regard to the coin diameter sensor 450, there are other types of sensing systems which can detect the diameter of a coin. These various types of coin diameter sensors will be described with reference to FIGS. 17–27.

Figure 18:
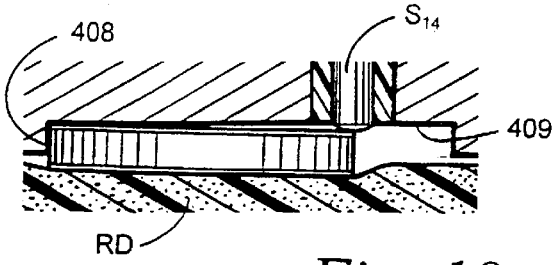
FIG. 18 is a cross-sectional view taken along line 18—18 in FIG. 17 which illustrates the relationship of the sensors to the coin being sensed.
Figure 19:
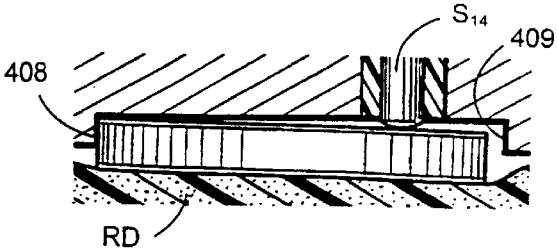
FIG. 19 is a cross-sectional view taken along line 18—18 in FIG. 17 which illustrates the relationship of the sensor to the coin being sensed.
Figure 20:
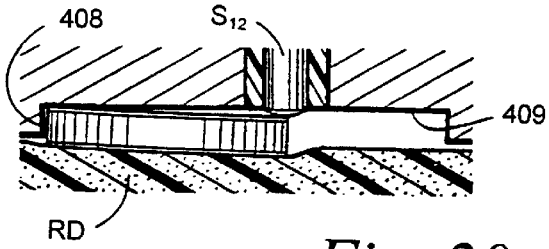
FIG. 20 is a cross-sectional view taken through line 20—20 in FIG. 17 which illustrates the relationship of the sensors to the sensed coin.
Figure 21:
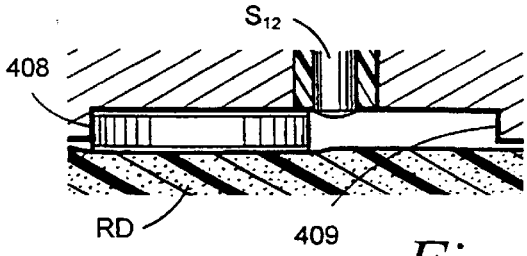
FIG. 21 is a cross-sectional view taken through line 20—20 in FIG. 17 which illustrates the relationship of the sensors to the sensed coin.

In the coin diameter sensors of FIGS. 17–21, reference will be made to the U.S. coin set only. But, it shall be understood that such a system will be applicable to coin sets of more than one country. The six sensors $S_{11}$–$S_{16}$ are spaced apart from each other in the radial direction so that one of the sensors is engaged only by half dollars, and each of the other sensors is engaged by a different combination of coin denominations. For example, as illustrated in FIGS. 18 and 19, the sensor $S_{14}$, engages not only quarters (FIG. 18) but also all larger coins (FIG. 19), while missing all coins smaller than the quarter. On the other hand, sensor $S_{12}$ engages a penny (FIG. 20) and all coins larger than the penny, but misses a dime (FIG. 21).

The entire array of sensors produces a unique combination of signals for each different coin denomination, as illustrated by the following table where a "1" represents engagement with the sensor and a "0" represents non-engagement with the sensor:

| | $P_1$ | $P_2$ | $P_3$ | $P_4$ | $P_5$ | $P_6$ |
|---|---|---|---|---|---|---|
| 10¢ | 1 | 0 | 0 | 0 | 0 | 0 |
| 1¢ | 1 | 1 | 0 | 0 | 0 | 0 |
| 5¢ | 1 | 1 | 1 | 0 | 0 | 0 |
| 25¢ | 1 | 1 | 1 | 1 | 0 | 0 |
| $1 | 1 | 1 | 1 | 1 | 1 | 0 |
| 50¢ | 1 | I | 1 | 1 | 1 | 1 |

By analyzing the combination of signals produced by the six sensors $S_{11}$–$S_{16}$ in response to the passage of any coin thereover, the denomination of that coin is determined immediately, and the actual count for that denomination can be incremented directly without the use of any subtraction algorithm. Also, this sensor arrangement minimizes the area of the sector that must be dedicated to the sensors on the lower surface of the sorting head. Of course, the number of sensors can be increased such that the coin loader 6 is able to sense the total number of coins contained in two coin sets of two countries.

The analysis of the signals produced by the six sensors $S_{11}$–$S_{16}$ in response to any given coin can be simplified by detecting only that portion of each combination of signals that is unique to one denomination of coin. As can be seen from the above table, these unique portions are $P_1=0$ and $P_2=1$ for the dime, $P_2=0$ and $P_3=1$ for the penny, $P_3=0$ and $P_4=1$ for the nickel, $P_4=0$ and $P_5=1$ for the quarter, $P_5=0$ and $P_6=1$ for the dollar, and $P_6=1$ for the half dollar.

As an alternative to the signal-processing system described above, the counts $C_1$–$C_6$ of the pulses $P_1$–$P_6$ from the six sensors $S_{11}$–$S_{16}$ in FIGS. 17–21 may be processed as follows to yield actual counts $C_D$, $C_P$, $C_N$, $C_Q$, $C_S$ and $C_H$ of dimes, pennies, nickels, quarters, dollars and half dollars:

$$C_D=C_1-C_2$$

$$C_P=C_2-C_3$$

$$C_N=C_3-C_4$$

$$C_Q=C_4-C_5$$

$$C_S=C_5-C_6$$

$$C_H=C_6$$

Figure 22:
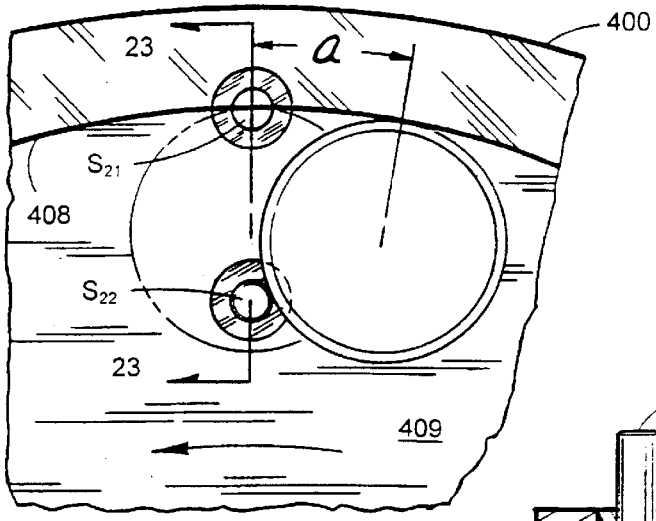
FIG. 22 is yet a further alternative coin diameter sensing mechanism which can be used in the discrimination heads of FIGS. 10 and 11.
Figure 23:
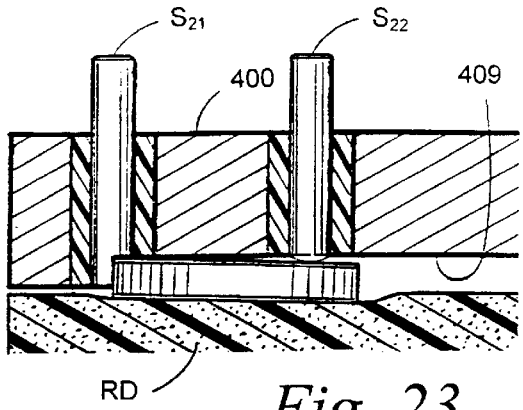
FIG. 23 is a cross-sectional view taken along line 23—23 in FIG. 22 which illustrates the relationship of the sensors to the coin being sensed.

Still another coin diameter sensor is shown in FIGS. 22 and 23. In this arrangement, only two sensors are used to detect all denominations. One of the sensors $S_{21}$ is located in the queuing wall 408 that guides the coins while they are being sensed through the sensing area 408, and the other sensor $S_{22}$ is spaced radially away from the sensor $S_{21}$ by a distance that is less than the diameter of the smallest coin to be sensed by $S_{22}$. Every coin engages both sensors $S_{21}$ and $S_{22}$, but the time interval between the instant of initial engagement with $S_{22}$ and the instant of initial engagement with $S_{21}$ varies according to the diameter of the coin. A large-diameter coin engages $S_{22}$ earlier (relative to the engagement with $S_{21}$) than a small-diameter coin. Thus, by measuring the time interval between the initial contacts with the two sensors $S_{21}$ and $S_{22}$ for any given coin, the diameter of that coin can be determined.

Alternatively, the encoder on the periphery of the rotatable disc RD can be used to measure the angular displacement a of each coin from the time it initially contacts the sensor $S_{21}$ until it initially contacts the sensor $S_{22}$. This angular displacement a increases as the diameter of the coin increases so that the diameter of each coin can be determined from the magnitude of the measured angular displacement. This denomination-sensing technique is insensitive to variations in the rotational speed of the disc RD because it is based on the position of the coin, not its speed.

Figure 24:
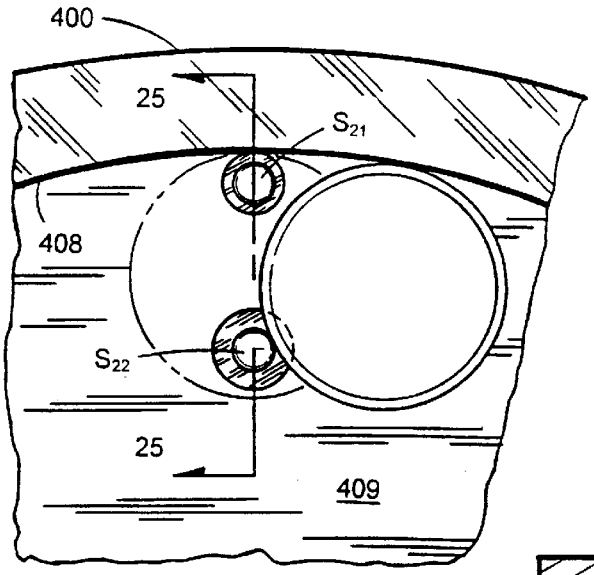
FIG. 24 is a modified version of the coin diameter sensing mechanism in FIG. 22.
Figure 25:
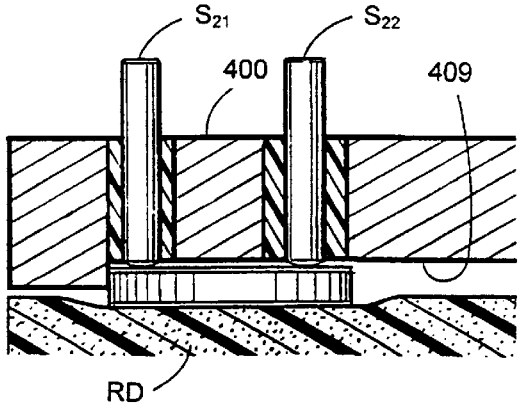
FIG. 25 is a cross-sectional view taken through line 25—25 in FIG. 24 which illustrates the relationship of the sensors to the coin being sensed.

FIGS. 24 and 25 show a modified form of the two-sensor arrangement of FIGS. 22 and 23. In this case the sensor $S_{21}$ engages the flat side of the coin rather than the edge of the coin. Otherwise the operation is the same.

Figure 26:
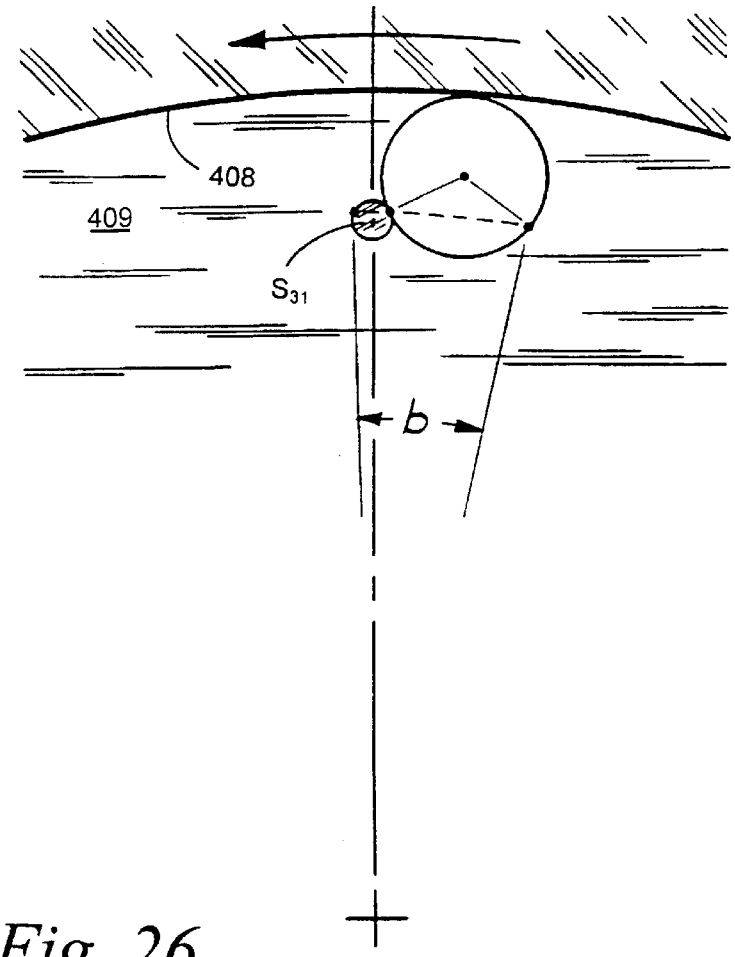
FIG. 26 is yet a further alternative coin diameter sensing mechanism which utilizes only one sensor positioned outward from the engaging wall.
Figure 27:
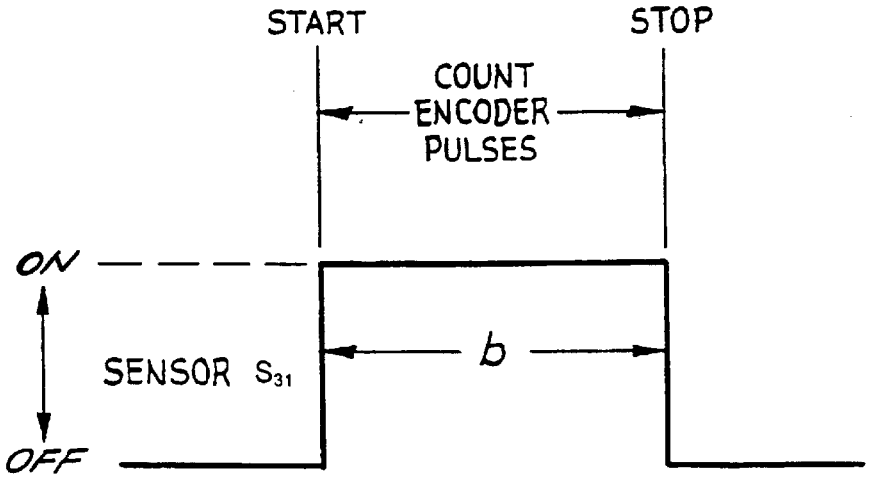
FIG. 27 is the typical output of the sensor in FIG. 26 which is monitored by the controller for the coin loader.

Another modified counting arrangement is shown in FIG. 26. This arrangement uses a single sensor $S_{31}$ which is spaced away from the queuing wall 408 in the sensing region 409 by a distance that is less than the diameter of the smallest coin. Each coin denomination traverses the sensor $S_{31}$ over a unique range of angular displacement b, which can be accurately measured by the encoder on the periphery of the rotatable disc RD, as illustrated by the timing diagram in FIG. 27. The counting of pulses from the encoder sensor is started when the leading edge of a coin first contacts the sensor $S_{31}$, and the counting is continued until the trailing edge of the coin clears the sensor. As mentioned previously, the sensor will not usually produce a uniform flat pulse, but there is normally a detectable rise or fall in the sensor output signal when a coin first engages the sensor, and again when the coin clears the sensor. Because each coin denomination requires a unique angular displacement b to traverse the sensor, the number of encoder pulses generated during the sensor-traversing movement of the coin provides a direct indication of the size, and therefore the denomination, of the coin.

Turning now to FIGS. 28–31, one type of magnetic sensor 440 that can be used in the discrimination heads 400 and 500 is an eddy current sensor 710 that detects the metal content of the coins and, therefore, is useful for determining whether a coin is from Country A or Country B. The details of this coin discrimination methodology are disclosed in U.S. Pat.

No. 5,630,494 which is herein incorporated by reference in its entirety and will be generally described with reference to FIGS. 28-31.

The eddy current sensor 710 includes an excitation coil 712 for generating an alternating magnetic field used to induce eddy currents in a coin 714. The excitation coil 712 has a start end 716 and a finish end 718. An embodiment an a-c. excitation coil voltage $V_{ex}$, e.g., a sinusoidal signal of 250 KHz and 10 volts peak-to-peak, is applied across the start end 716 and the finish end 718 of the excitation coil 712. The alternating voltage $V_{ex}$ produces a corresponding current in the excitation coil 712 which in turn produces a corresponding alternating magnetic field. The alternating magnetic field exists within and around the excitation coil 712 and extends outwardly to the coin 714. The magnetic field penetrates the coin 714 as the coin is moving in close proximity to the excitation coil 712, and eddy currents are induced in the coin 714 as the coin moves through the alternating magnetic field. The strength of the eddy currents flowing in the coin 714 is dependent on the material composition of the coin, and particularly the electrical resistance of that material. Resistance affects how much current will flow in the coin 714 according to Ohm's Law (voltage= current*resistance).

The eddy currents themselves also produce a corresponding magnetic field. A proximal detector coil 722 and a distal coil 724 are disposed above the coin 714 so that the eddy current-generated magnetic field induces voltages upon the coils 722, 724. The distal detector coil 724 is positioned above the coin 714, and the proximal detector coil 722 is positioned between the distal detector coil 724 and the passing coin 714.

In one embodiment, the excitation coil 712, the proximal detector coil 722 and the distal detector coil 724 are all wound in the same direction (either clockwise or counterclockwise). The proximal detection coil 722 and the distal detector coil 724 are wound in the same direction so that the voltages induced on these coils by the eddy currents are properly oriented.

The proximal detection coil 722 has a starting end 726 and a finish end 728. Similarly, the distal coil 724 has a starting end 730 and a finish end 732. In order of increasing distance from the coin 114, the detector coils 722, 724 are positioned as follows: finish end 728 of the proximal detector coil 722, start end 726 of the proximal detector coil 722, finish end 732 of the distal detector coil 724 and start end 730 of the distal detector coil 724. The finish end 728 of the proximal detection coil 722 is connected to the finish end 732 of the distal detector coil 724 via a conductive wire. It will be appreciated by those skilled in the art that other detector coil 722, 724 combinations are possible. For example, in an alternative embodiment the proximal detection coil 722 is wound in the opposite direction of the distal detection coil 724. In this case the start end 726 of the proximal coil 722 is connected to the finish end 732 of the distal coil 724.

Eddy currents in the coin 714 induce voltages $V_{prox}$ and $V_{dist}$ respectively on the detector coils 722, 724. Likewise, the excitation coil 712 also induces a common-mode voltage $V_{com}$ on each of the detector coils 722, 724. The common-mode voltage $V_{com}$ is effectively the same on each detector coil due to the symmetry of the detector coils' physical arrangement within the excitation coil 712. Because the detector coils 722, 724 are wound and physically oriented in the same direction and connected at their finish ends 728, 732, the common-mode voltage $V_{com}$ induced by the excitation coil 712 is subtracted out, leaving only a difference voltage $V_{diff}$ corresponding to the eddy currents in the coin 714. This eliminates the need for additional circuitry to subtract out the common-mode voltage $V_{com}$. The common-mode voltage $V_{com}$ is effectively subtracted out because both the distal detection coil 724 and the proximal detection coil 722 receive the same level of induced voltage $V_{com}$ from the excitation coil 712.

Unlike the common-mode voltage, the voltages induced by the eddy current in the detector coils are not effectively the same. This is because the proximal detector coil 722 is purposely positioned closer to the passing coin than the distal detector coil 724. Thus, the voltage induced in the proximal detector coil 722 is significantly stronger, i.e. has greater amplitude, than the voltage induced in the distal detector coil 724. Although the present invention subtracts the eddy current-induced voltage on the distal coil 724 from the eddy current-induced voltage on the proximal coil 722, the voltage amplitude difference is sufficiently great to permit detailed resolution of the eddy current response.

Figure 28:
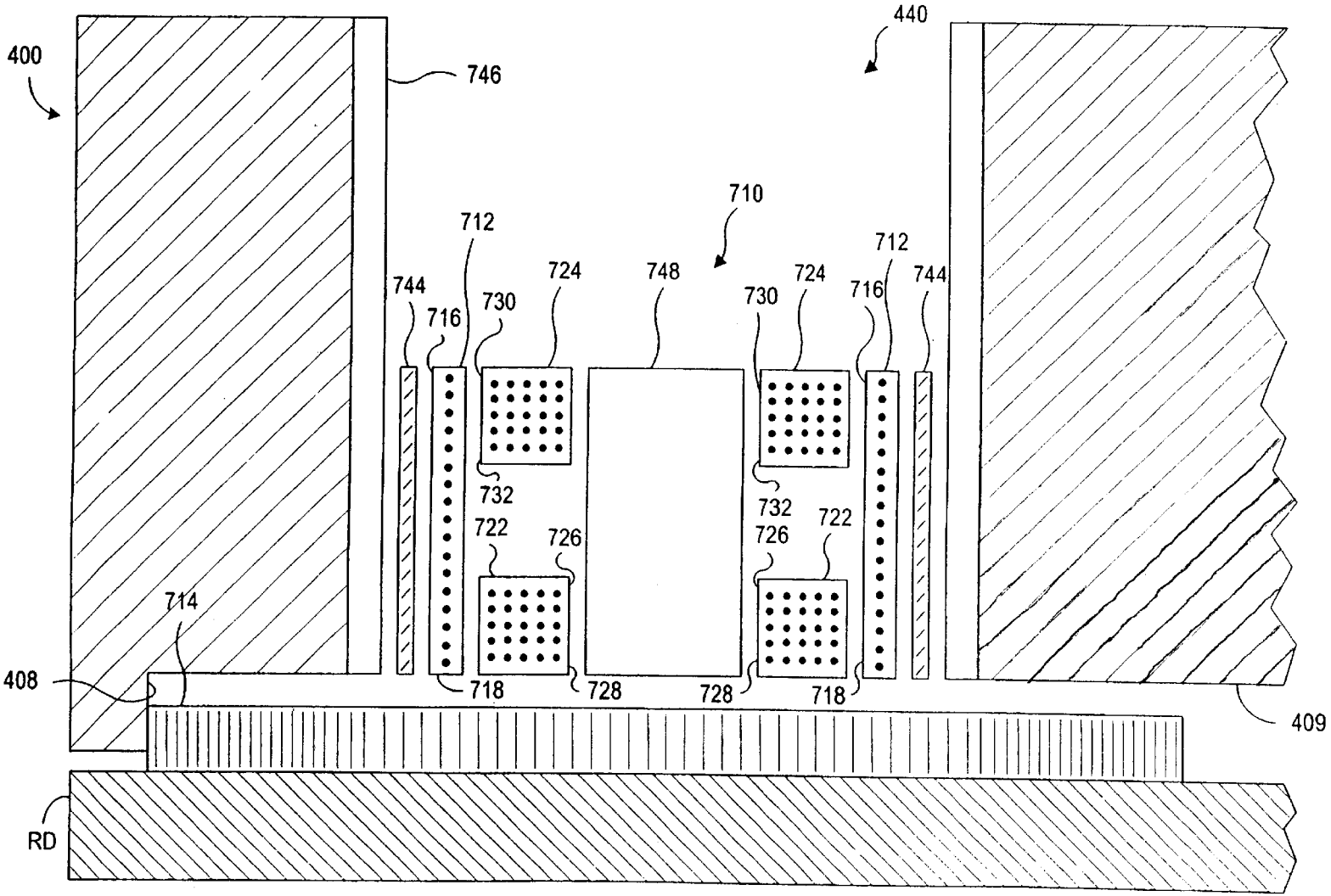
FIG. 28 is a cross-sectional view through the coin discrimination head in FIG. 10 through the magnetic sensor which illustrates one type of magnetic sensor that can be used with the discrimination head to detect the material content of the coins.
Figure 29:
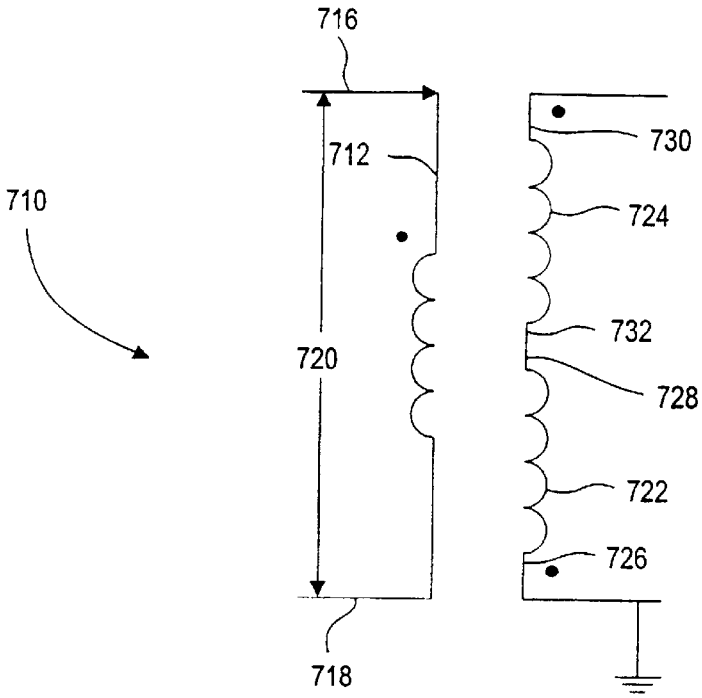
FIG. 29 is a schematic circuit diagram of the magnetic sensor of FIG. 28.
Figure 30:
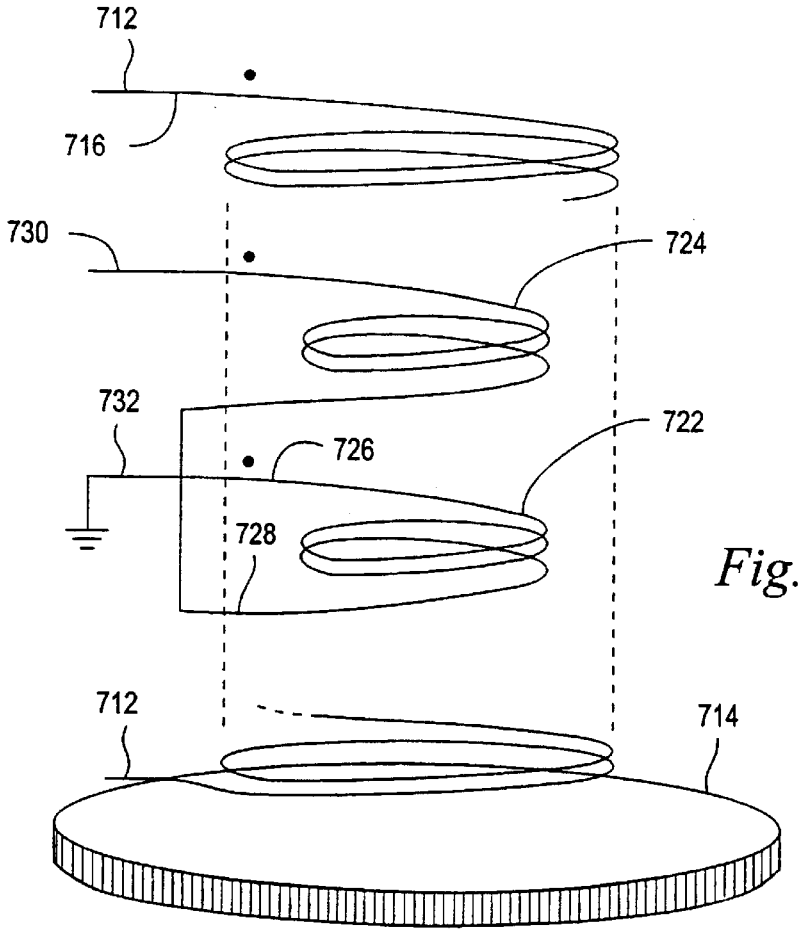
FIG. 30 is a diagrammatic perspective view of the coils in the magnetic sensor of FIG. 28.

As seen in FIG. 28, the excitation coil 712 is radially surrounded by a magnetic shield 744. The magnet shield 744 has a high level of magnetic permeability in order to help contain the magnetic field surrounding the excitation coil 712. The magnetic shield 744 has the advantage of preventing stray magnetic field from interfering with other nearby eddy current sensors. The magnetic shield is itself radially surrounded by a steel outer case 746.

In one embodiment the excitation coil utilizes a cylindrical ceramic (e.g., alumina) core 748. Alumina has the advantages of being impervious to humidity and providing a good wear surface. It is desirable that the core 748 be able to withstand wear because it may come into frictional contact with the coin 714. Alumina withstands frictional contact well because of its high degree of hardness, i.e., approximately 9 on mohs scale.

To form the eddy current sensor 710, the detection coils 722, 724 are wound on a coil form (not shown). A preferred form is a cylinder having a length of 0.5 inch, a maximum diameter of 0.2620 inch, a minimum diameter of 0.1660 inch, and two grooves of 0.060 inch width spaced apart by 0.060 inch and spaced from one end of the form by 0.03 inch. Both the proximal detection coil 722 and the distal detector coil 724 have 350 turns of #44 AWG enamel covered magnet wire layer wound to generally uniformly fill the available space in the grooves. Each of the detector coils 722, 724 are wound in the same direction with the finish ends 728, 732 being connected together by the conductive wire. The start ends 726, 730 of the detector coils 722, 724 are connected to separately identified wires in a connecting cable.

The excitation coil 712 is a generally uniformly layer wound on a cylindrical alumina ceramic coil form having a length of 0.5 inch, an outside diameter of 0.2750 inch, and a wall thickness of 0.03125 inch. The excitation coil 712 is wound with 135 turns of #42 AWG enamel covered magnet wire in the same direction as the detector coils 722, 724. The excitation coil voltage $V_{ex}$ is applied across the start end 716 and the finish end 718.

After the excitation coil 712 and detector coils 722, 724 are wound, the excitation coil 712 is slipped over the detector coils 722, 724 around a common center axis. At this time the sensor 710 is connected to a test oscillator (not shown) which applies the excitation voltage $V_{ex}$ to the excitation coil 712. The excitation coil's position is adjusted along the axis of the coil to give a null response from the detector coils 722, 724 on an a-c. voltmeter with no metal near the coil windings.

Then the magnetic shield 744 is the slipped over the excitation coil 712 and adjusted to again give a null response from the detector coils 722, 724. The magnetic shield 744 and coils 712, 722, 724 within the magnetic shield 744 are then placed in the steel outer case 746 and encapsulated with a polymer resin (not shown) to "freeze" the position of the magnetic shield 744 and coils 712, 722, 724. After curing the resin, an end of the eddy current sensor 710 nearest the proximal detector coil 722 is sanded and lapped to produce a flat and smooth surface with the coils 712, 722 slightly recessed within the resin.

In order to detect the effect of the coin 714 on the voltages induced upon the detector coils 722, 724, it is preferred to use a combination of phase and amplitude analysis of the detected voltage. This type of analysis minimizes the effects of variations in coin surface geometry and in the distance between the coin and the coils.

The voltage applied to the excitation coil 712 causes current to flow in the coil 712 which lags behind the voltage 720. For example, the current may lag the voltage 720 by 90 degrees in a superconductive coil. In effect, the eddy currents of the coin 714 impose a resistive loss on the current in the excitation coil 712. Therefore, the initial phase difference between the voltage and current in the excitation coil 712 is decreased by the presence of the coin 714. Thus, when the detector coils 724, 726 have a voltage induced upon them, the phase difference between the voltage applied to the excitation coil 712 and that of the detector coils is reduced due to the eddy current effect in the coin. The amount of reduction in the phase difference is proportional to the electrical and magnetic characteristics of the coin and thus the composition of the coin. By analyzing both the phase difference and the maximum amplitude, an accurate assessment of the composition of the coin is achieved.

Figure 31A:
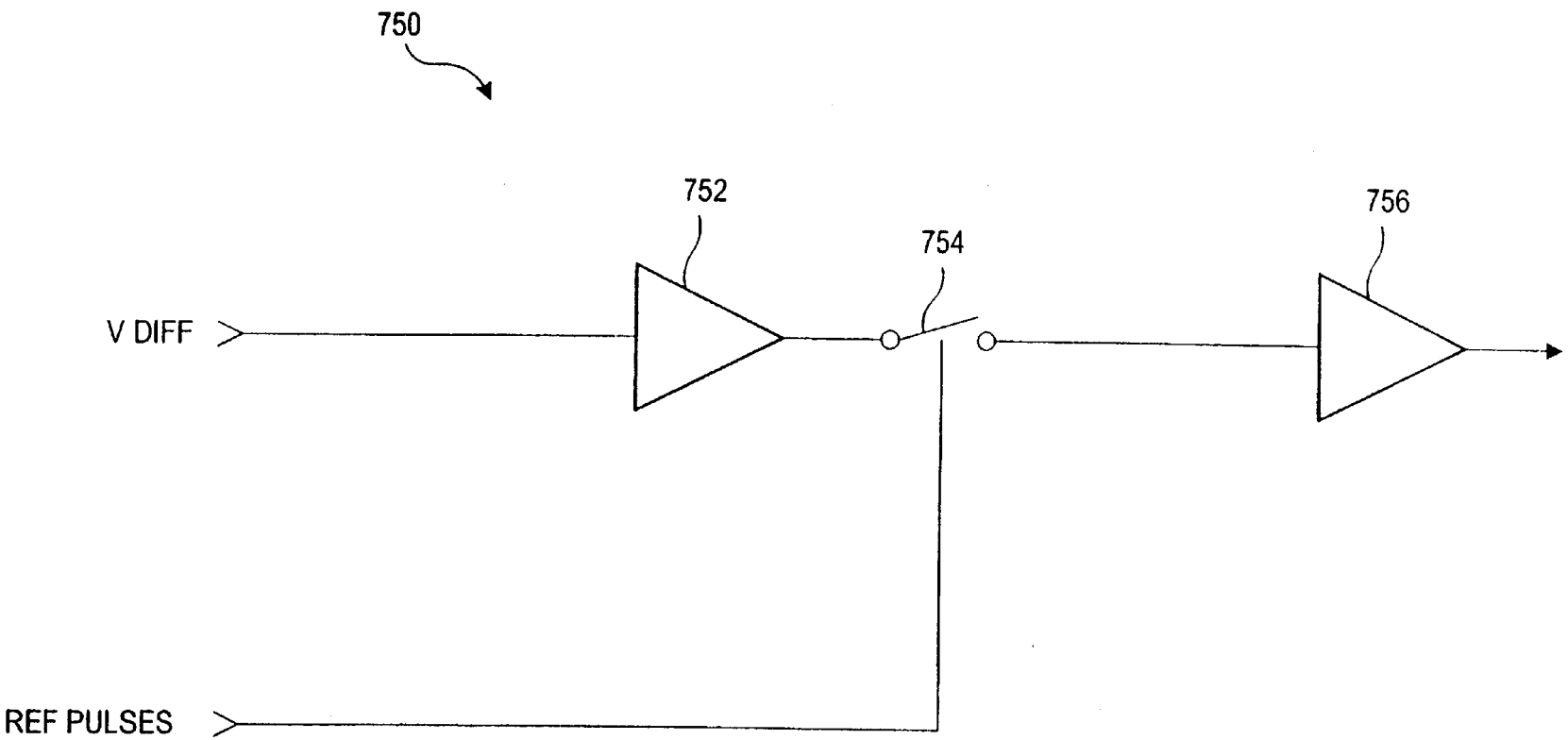
FIG. 31A is a circuit diagram of the detector circuit that is used with the magnetic sensor of FIG. 28.
Figure 31B:
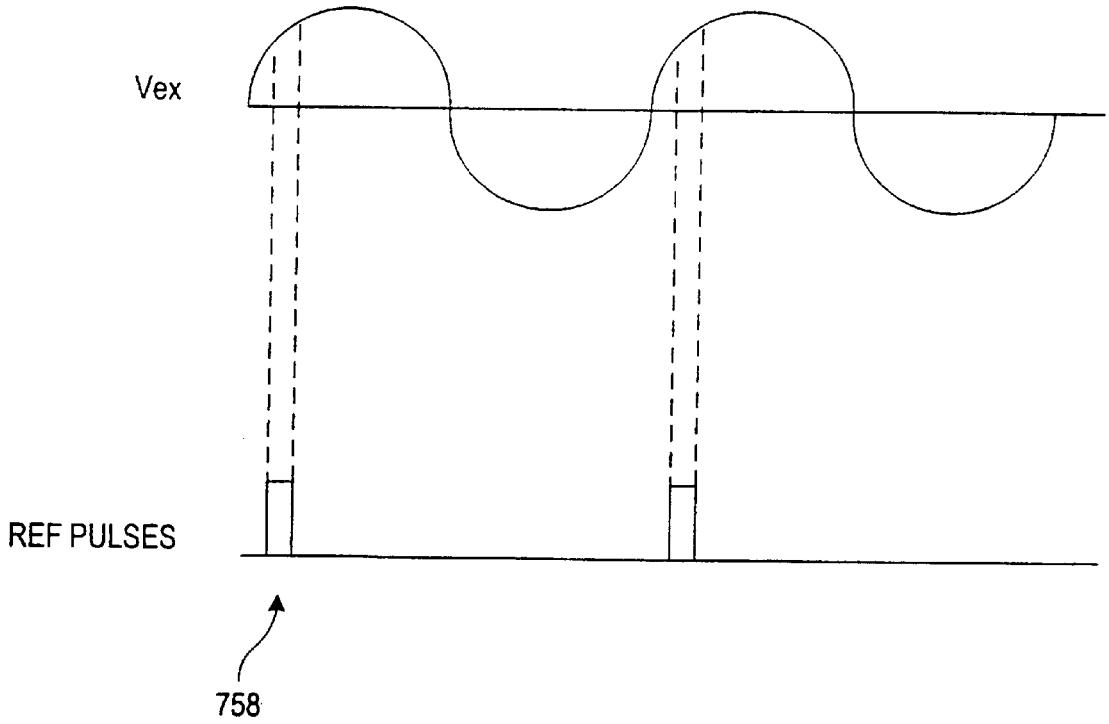
FIG. 31B is a waveform diagram of the input signal supplied to the circuit in FIG. 31A.

FIGS. 31A and 31B illustrate a preferred phase-sensitive detector 750 for sampling the differential output signal $V_{diff}$ from the two detector coils 722, 724. The differential output signal $V_{diff}$ is passed through a buffer amplifier 752 to a switch 754, where the buffered $V_{diff}$ is sampled once per cycle by momentarily closing the switch 754. The switch 754 is controlled by a series of reference pulses produced from the $V_{ex}$ signal, one pulse per cycle. The reference pulses 758 are synchronized with excitation voltage $V_{ex}$, so that the amplitude of the differential output signal $V_{diff}$ during the sampling interval is a function not only of the amplitude of the detector coil voltages 736, 738, but also of the phase difference between the signals in excitation coil 712 and the detection coils 736, 738.

The pulses derived from $V_{ex}$ are delayed by an "offset angle" which can be adjusted to minimize the sensitivity of $V_{diff}$ to variations in the gap between the proximal face of the sensor 710 and the surface of the coin 714 being sensed. The value of the offset angle for any given coin can be determined empirically by moving a standard metal disc, made of the same material as the coin 714, from a position where it contacts the sensor face, to a position where it is spaced about 0.001 to 0.020 inch from the sensor face. The signal sample from the detector 750 is measured at both positions, and the difference between the two measurements is noted. This process is repeated at several different offset angles to determine the offset angle which produces the minimum difference between the two measurements.

Each time buffered $V_{diff}$ is sampled, the resulting sample is passed through a second buffer amplifier 756 to an analog-to-digital converter (not shown). The resulting digital value is supplied to the controller for the coin loader 6 which compares that value with several different ranges of values stored in a lookup table. Each stored range of values corresponds to a particular coin material, and thus the coin material represented by any given sample value is determined by the particular stored range into which the sample value falls. The stored ranges of values can be determined empirically by simply measuring a batch of coins of each denomination and storing the resulting range of values measured for each denomination. Consequently, by providing the eddy current sensor 710 which determines the metal content of the coins, the coin loader 6 can differentiate between the coin sets of two currencies and sort these coins into the two coin sets, set 1 for Country A and set 2 for Country B.

As stated previously, the coin processing system 5 is useful in regions of the world where coins from two different countries are in circulation. Furthermore, when the new set of European coins are introduced, these new European coins will be used at least for some time while the coins of each specific country in Europe are still in circulation. Accordingly, many of the retailers and banks on the European continent will be required to accept both the new European coins and also the coins of their specific country. Consequently, the coin processing system 5 will be especially useful for these retailers and banks.

Additionally, because the coin processing system 5 can be broken down into its components (i.e. the two coin sorters 10 and the coin loader 6), the coin processing system 5 is especially useful when the coin sorters 10 are configured with the rotatable disc and stationary sorting head technology that is shown in FIGS. 1–4. The reason for this is that the sorting heads 14 can be easily interchanged. Thus, after the transitional time period during which both the new European coins and the coins of each specific country are in circulation, the sorting head 14 for the coin sorter 10 which was dedicated to the coins of the specific country can be removed and replaced with a sorting head 14 that will sort the new European coin set. Consequently, the retailer or bank will then have two coin sorters 10 which will be useful for sorting the new European coin set.

It should further be noted that while the coin processing system 5 has been described as a system which sorts a mixed batch of coins form two different countries, the configuration of the loader 6 can be modified to include multiple diverting mechanisms. For example, if two diverting mechanisms are present on the discrimination head 400 or 500 and three exit channels are provided, the coin processing system 5 could sort coins from three different countries into three coin chutes which lead to three separate coin sorters 10. In such a configuration, the controller for the loader 6 would actuate neither, one, or both diverting mechanisms to send a coin which has been sensed by the sensors 430, 440, 450, and/or 460 to one of the three coin chutes.

While the invention is susceptible to various modifications and alternative forms, specific embodiment thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention.

What is claimed is:

1. A system for processing mixed coins including coins from a first coin set and coins from a second coin set, comprising:

a coin set discrimination device including a coin input region in which said mixed coins are placed, a first exit region for discharging said first coin set, and a second exit region for discharging said second coin set, said coin set discrimination device further including means for discriminating between coins of said first coin set and coins of said second coin set and means for transporting coins of said first coin set to said first exit region and coins of said second coin set to said second exit region; said transport means includes a stationary discrimination head and a rotatable disc, said rotatable disc imparting motion to said mixed coins and moving said mixed coins across said stationary discrimination head; and a first coin sorter receiving said coins from said first exit region, said first coin sorter sorting and counting coins of said first coin set; and a second coin sorter receiving said coins from said second exit region, said second coin sorter sorting and counting coins of said second coin set.

2. The coin processing system of claim 1, wherein said stationary discrimination head is spaced slightly away from said rotatable disc.

3. The coin processing system of claim 2, wherein said stationary discrimination head includes said discriminating means.

4. The coin processing system of claim 3, wherein said discriminating means includes an imaging sensor.

5. The coin processing system of claim 3, wherein said discriminating means includes a magnetic sensor.

6. The coin processing system of claim 3, wherein said discriminating means includes a coin diameter sensor.

7. The coin processing system of claim 3, wherein said discriminating means includes a coin thickness sensor.

8. The coin processing system of claim 1, wherein said transport means includes a stationary discrimination head and a rotatable disc, said rotatable disc moving coins along an outwardly spiraling queuing path within said discrimination head.

9. The coin processing system of claim 8, wherein said discriminating means is located along said queuing path within said discrimination head.

10. The coin processing system of claim 9, wherein said stationary discrimination head includes, beyond said queuing path, two exit channels leading to said two exit regions.

11. The coin processing system of claim 10, wherein said stationary discrimination head includes a mechanical divertor to selectively allow coins to move into one of said two exit channels.

12. The coin processing system of claim 1, wherein at least one of said first and second coin sorters includes a stationary sorting head and a rotatable disc.

13. The coin processing system of claim 1, wherein at least one of said first and second coin sorters includes a rail having openings therein for sorting said coins.

14. The coin processing system of claim 1, wherein at least one of said first and second coin sorters includes a first and second rotating discs having overlapping edges, said coins being passed from said first rotating disc to said second rotating disc which sorts said coins.

15. The coin processing system of claim 1, wherein said first and second coin sorters have sorting structures for sorting, respectively, said first coin set and said second coin set, said sorting structures being interchangeable between said first and second coin sorters.

16. The coin processing system of claim 1, wherein said coin processing system is separable into subcomponents, said first and second coins sorters each being an independently operable subcomponent.

17. The coin processing system of claim 16, wherein said first and second coin sorters have sorting structures for sorting, respectively, said first coin set and said second coin set, said sorting structures being interchangeable between said first and second coin sorters.

18. The coin processing system of claim 17, wherein each of said sorting structures is a stationary sorting head having a lower surface forming a plurality of exit channels for discharging coins of a particular denomination of said respective coin set.

19. A coin processing system for separating mixed coins including coins from a first coin set and coins from a second coin set, said first and second coin sets both including coins of different diameters, comprising:

a rotatable disc having a resilient upper surface;

a stationary sorting head having a lower surface generally parallel to and spaced slightly from said resilient upper surface of said rotatable disc, said lower surface of said sorting head forming first and second exit channels for discharging, respectively, said first and second coin sets; said lower surface forming an outwardly spiraling coin queuing region extending from a coin input region and into said first exit channel;

a discrimination sensor within said sorting head for sensing said mixed coins as said mixed coins move through said coin queuing region;

a mechanical divertor within said first exit channel capable of movement between an open position allowing coins to continue through said first exit channel and a closed position forcing said coins toward said second exit channel;

a controller for monitoring said discrimination sensor and selectively actuating said mechanical divertor to move coins between said first and second exit channels;

a first coin tabulating mechanism for determining the value of said first coin set exiting from said first exit channel; and a second coin tabulating mechanism for determining the value of said second coin set exiting from said second exit channel.

20. The coin processing system of claim 19, wherein said discrimination sensor includes an imaging sensor.

21. The coin processing system of claim 19, wherein said discrimination sensor includes a magnetic sensor.

22. The coin processing system of claim 19, wherein said discrimination sensor includes a coin diameter sensor.

23. The coin processing system of claim 19, wherein said discrimination sensor includes a coin thickness sensor.

24. The coin processing system of claim 19, wherein said queuing region merging smoothly into said first exit channel.

25. The coin processing system of claim 19, wherein said first and second channels are recesses on said lower surface extending deeper into said lower surface than said queuing region.

26. The coin processing system of claim 19, wherein said divertor mechanism is located adjacent to a periphery of said sorting head within said first exit channel.

27. The coin processing system of claim 19, wherein said divertor mechanism forces said coins across an edge on said lower surface of said sorting head, under pressure from said resilient upper surface, to said second exit channel.

28. A system for processing mixed coins including coins from a first coin set and coins from a second coin set said first and second coin sets both including coins of various diameters, comprising:

a coin handling device including a coin input region in which said mixed coins are placed, a first exit region for discharging said first coin set, and a second exit region for discharging said second coin set, said coin handling device further including means for discriminating between coins of said first coin set and coins of said second coin set, and means for transporting said first coin set to said first exit region and said second coin set to said second exit region;

a first coin sorter receiving said coins from said first exit region, said first coin sorter being independently operable apart from said coin processing system and including a first sorting structure which mechanically sorts at least two denominations of said first coin set, said first sorting structure being interchangeable with other sorting structures associated with different coin sets; and a second coin sorter receiving said coins from said second exit region, said second coin sorter being independently operable apart from said coin processing system and including a second sorting structure which mechanically sorts at least two denominations of said second coin set, said second sorting structure being interchangeable with other sorting structures associated with different coin sets.

29. The coin processing system of claim 28, wherein each of said sorting structures is a generally circular stationary sorting head having a lower surface forming a plurality of exit channels for discharging coins of different denominations from said respective coin set.

30. The coin processing system of claim 28, wherein said first and second sorting structures are interchangeable.

31. A method of sorting and counting mixed coins including coins from a first coin set and coins from a second coin set, comprising the steps of:

placing said mixed coins in a discrimination machine having a discrimination sensor;

discriminating between coins of said first coin set and coins of said second coin set with said discrimination sensor;

sorting coins of said first coin set from coins of said second coin set based on said discrimination sensor while said mixed coins are within said discrimination machine;

automatically transporting said first coin set from said discrimination machine to a first coin sorter adjacent to said discrimination machine;

automatically transporting said second coin set from said discrimination machine to a second coin sorter adjacent to said discrimination machine, said second coin sorter being independent of said first coin sorter;

sorting said first coin set into denominations of said first coin set with said first coin sorter;

sorting said second coin set into denominations of said second coin set with said second coin sorter;

counting each of said denominations of said first coin set; and counting each of said denominations of said second coin set.

32. A system for processing mixed coins including coins from a first coin set and coins from a second coin set, comprising:

a coin set discrimination device including a coin input region in which said mixed coins are placed, a first exit region for discharging said first coin set, and a second exit region for discharging said second coin set, said coin set discrimination device further including means for discriminating between coins of said first coin set and coins of said second coin set and means for transporting coins of said first coin set to said first exit region and coins of said second coin set to said second exit region;

a first coin sorter receiving said coins from said first exit region, said first coin sorter sorting and counting coins of said first coin set; and a second coin sorter receiving said coins from said second exit region, said second coin sorter sorting and counting coins of said second coin set; and wherein at least one of said first and second coin sorters includes a stationary sorting head and a rotatable disc.

33. A system for processing mixed coins including coins from a first coin set and coins from a second coin set, comprising:

a coin set discrimination device including a coin input region in which said mixed coins are placed, a first exit region for discharging said first coin set, and a second exit region for discharging said second coin set, said coin set discrimination device further including means for discriminating between coins of said first coin set and coins of said second coin set and means for transporting coins of said first coin set to said first exit region and coins of said second coin set to said second exit region;

a first coin sorter receiving said coins from said first exit region, said first coin sorter sorting and counting coins of said first coin set;

a second coin sorter receiving said coins from said second exit region, said second coin sorter sorting and counting coins of said second coin set; and wherein at least one of said first and second coin sorters includes a first and second rotating discs having overlapping edges, said coins being passed from said first rotating disc to said second rotating disc which sorts said coins.

34. A system for processing mixed coins including coins from a first coin set and coins from a second coin set, comprising:

a coin set discrimination device including a coin input region in which said mixed coins are placed, a first exit region for discharging said first coin set, and a second exit region for discharging said second coin set, said coin set discrimination device further including means for discriminating between coins of said first coin set and coins of said second coin set and means for transporting coins of said first coin set to said first exit region and coins of said second coin set to said second exit region;

a first coin sorter receiving said coins from said first exit region, said first coin sorter sorting and counting coins of said first coin set; and a second coin sorter receiving said coins from said second exit region, said second coin sorter sorting and counting coins of said second coin set.

35. A system for processing mixed coins including coins from a first coin set and coins from a second coin set, comprising:

a coin set discrimination device including a coin input region in which said mixed coins are placed and a coin discriminator for discriminating between coins from said first coin set and coins from said second coin set;

a first coin sorter receiving and counting said coins from said first coin set; and a second coin sorter receiving and counting said coins from said second coin set.

36. A coin processing system for processing mixed coins including coins from a first coin set of a first authority and coins from a second coin set of a second authority, said coin processing system discriminating between coins from said first coin set and coins from said second coin set.

37. A method of processing mixed coins including coins from a first coin set and coins from a second coin set, comprising the steps of:

discriminating between coins of said first coin set and coins of said second coin set with said discrimination sensor;

sorting coins of said first coin set from coins of said second coin set based on said discrimination sensor; and placing a monetary value on coins of said first coin set and coins of said second coin set.

* * * * *